US010557321B2

(12) United States Patent
Scekic et al.

(10) Patent No.: US 10,557,321 B2
(45) Date of Patent: Feb. 11, 2020

(54) SPINNING TORQUE WRENCH

(71) Applicant: DRILLFORM TECHNICAL SERVICES LTD., Calgary (CA)

(72) Inventors: Vladimir Scekic, New Westminster (CA); Radu Gnasienco, Coquitlam (CA); Russell Turnbull, Burnaby (CA); Kevin Batahla, Vancouver (CA)

(73) Assignee: DRILLFORM TECHNICAL SERVICES LTD., Calgary (CA)

( * ) Notice: Subject to any disclaimer, the term of this patent is extended or adjusted under 35 U.S.C. 154(b) by 82 days.

(21) Appl. No.: 15/803,149

(22) Filed: Nov. 3, 2017

(65) Prior Publication Data

US 2018/0051527 A1 Feb. 22, 2018

Related U.S. Application Data

(63) Continuation of application No. PCT/CA2016/050483, filed on Apr. 26, 2016.
(Continued)

(51) Int. Cl.
*E21B 19/16* (2006.01)
*B25B 27/04* (2006.01)
(Continued)

(52) U.S. Cl.
CPC ..... *E21B 19/164* (2013.01); *B25B 27/04* (2013.01); *E21B 19/166* (2013.01);
(Continued)

(58) Field of Classification Search
CPC .... E21B 19/164; E21B 19/166; E21B 19/167; E21B 19/20; B25B 27/04; B25B 13/14; B25B 13/50
(Continued)

(56) References Cited

U.S. PATENT DOCUMENTS 4,069,879 A 1/1978 Brown et al.
4,445,402 A 5/1984 Farr et al.
(Continued)

FOREIGN PATENT DOCUMENTS

GB 2 128 526 A 5/1984

OTHER PUBLICATIONS

International Search Report and Written Opinion dated Jun. 16, 2016 for International Application No. PCT/CA2016/050483 (7 pages).

*Primary Examiner* — Hadi Shakeri
(74) *Attorney, Agent, or Firm* — Sheridan Ross PC

(57) ABSTRACT

A torque wrench is provided. The torque wrench has housing and a rotating assembly rotatably mounted in the housing. The rotating assembly has a gripping assembly with an aperture for receiving a tubular and a plurality of die assemblies; a bevel pinion carrier assembly with a bevel pinion carrier and a bevel pinion mounted in the bevel pinion carrier; an upper ring gear fixed to an upper bevel gear rotatably connected to the bevel pinion at an upper side of the bevel pinion carrier; a lower ring gear fixed to a lower bevel gear rotatably connected to the bevel pinion at a lower side of the bevel pinion carrier; and first and second members threadably coupleable with each other, the first threadably coupleable member fixedly connected to the bevel pinion and the second threadably coupleable member drivingly connected to the die assembly, wherein rotation of the bevel pinion drives the die assembly toward and away from the tubular.

20 Claims, 20 Drawing Sheets

Related U.S. Application Data

(60) Provisional application No. 62/166,845, filed on May 27, 2015.

(51) Int. Cl.
*E21B 19/20* (2006.01)
*B25B 13/14* (2006.01)
*B25B 13/50* (2006.01)

(52) U.S. Cl.
CPC ..... *E21B 19/167* (2013.01); *E21B 19/20* (2013.01); *B25B 13/14* (2013.01); *B25B 13/50* (2013.01)

(58) Field of Classification Search
USPC ..... 81/57.16
See application file for complete search history.

(56) References Cited

U.S. PATENT DOCUMENTS

| | | | | |
|---|---|---|---|---|
| 6,814,149 | B2 | 11/2004 | Liess et al. | |
| 7,281,451 | B2 * | 10/2007 | Schulze Beckinghausen | E21B 19/164 81/57.16 |
| 7,836,795 | B2 * | 11/2010 | Vatne | E21B 19/164 81/57.15 |
| 9,988,863 | B2 * | 6/2018 | Gaskin | E21B 19/15 |
| 2012/0198954 | A1 * | 8/2012 | Musemeche | E21B 19/164 74/414 |
| 2015/0143960 | A1 | 5/2015 | Hu et al. | |

* cited by examiner

SPINNING TORQUE WRENCH

CROSS REFERENCE TO RELATED APPLICATIONS

This is a continuation of PCT application No. PCT/CA2016/050483, entitled "SPINNING TORQUE WRENCH", filed Apr. 26, 2016, which claims priority to U.S. Provisional Patent Application 62/166,845, filed May 27, 2015, each of which are incorporated herein by reference.

BACKGROUND OF THE INVENTION

This invention relates to torque wrenches, for example oilfield tubular torque wrenches.

When operating an oilfield tubular torque wrench (also known as a roughneck or a power tong), torque provided by a prime mover has to be applied to a tubular. Since tubulars do not feature any flat surfaces (such as a hex) around the circumference, the torque transfer from the wrench to the tubular has to be achieved through friction grip between the wrench's dies and the tubular itself. Since friction force is directly proportional to the coefficient of friction and the perpendicular (gripping) force, there is a strong correlation between the gripping force and maximum torque that can be transferred from the dies to the tubular.

Conventional oilfield tubular torque wrenches rely on hydraulic pressure to grip the tubular. In such designs, the gripping force applied is independent in operation from the torque being applied, i.e., the two are independently controlled. As such, it is possible to apply high torque while having relatively low gripping force which can lead to the dies slipping around the tubular and damaging it.

Some oilfield tubular torque wrenches rely on cam profiles to grip the tubular. In such designs, a pre-designed correlation exists between the torque and gripping force applied thus providing virtually slip-free operation. However, wrenches typically have limited gripping stroke which necessitates changing out the dies every time the diameter of the tubular changes.

Improved torque wrenches that address at least some of the foregoing problems are desirable.

SUMMARY OF THE INVENTION

The inventions described herein have many aspects. According to one aspect, a torque wrench is provided. The torque wrench has housing and a rotating assembly rotatably mounted in the housing. The rotating assembly comprises a gripping assembly comprising an aperture for receiving a tubular and a plurality of die assemblies; a bevel pinion carrier assembly comprising a bevel pinion carrier and a bevel pinion mounted in the bevel pinion carrier; an upper ring gear fixed to an upper bevel gear rotatably connected to the bevel pinion at an upper side of the bevel pinion carrier; a lower ring gear fixed to a lower bevel gear rotatably connected to the bevel pinion at a lower side of the bevel pinion carrier; and first and second members threadably coupleable with each other, the first threadably coupleable member fixedly connected to the bevel pinion and the second threadably coupleable member drivingly connected to the die assembly, wherein rotation of the bevel pinion drives the die assembly toward and away from the tubular. The torque wrench also has at least one upper drive pinion rotatably mounted to the housing, and rotatably connectable to the upper ring gear, and at least one lower drive pinion rotatably mounted to the housing, and rotatably connectable to the lower ring gear.

The torque wrench may comprise a plurality of bevel pinions circumferentially mounted in the bevel pinion carrier, and a plurality of die assemblies, each die assembly corresponding with a bevel pinion. Each die assembly may comprise a die carrier and at least one die for gripping the tubular. The die assembly may be slidably mounted in a die assembly carrier.

The torque wrench may comprise a plurality of torque transfer elements disposed between the bevel pinion carrier and the die assembly carrier.

The bevel pinion carrier and the die assembly carrier may each comprise corresponding recesses for partially receiving the torque transfer elements therebetween.

The first threadably coupleable member may comprise a threaded female carrier about which the bevel pinion is fixed.

The bevel pinion and the threaded female carrier may be integrally formed.

The second threadably coupleable member may comprise a threaded male actuating rod.

The threaded male actuating rod may be drivingly connected to the die assembly by an actuating rod adapter.

The torque wrench may comprise opposing pair of upper driving assemblies each comprising a motor and an upper drive pinion; and an opposing pair of lower driving assemblies each comprising a motor and a lower drive pinion, wherein the opposing pairs of upper driving assemblies and the opposing pairs of lower driving assemblies are circumferentially arranged in corresponding slots in a sidewall of the housing.

The upper ring gear and upper bevel gear may be integrally formed and the lower ring gear and the lower bevel gear are integrally formed.

The torque wrench may have two jaws, each jaw comprising a corresponding a C-shaped half of each of the housing and the rotating assembly, wherein the jaws are pivotally mounted at a jaw pivot, whereby the jaws are configurable in an open position to receive the tubular and a closed position to clamp the tubular.

The torque wrench may comprise a support assembly, the support assembly comprising a support plate and a pair of articulating support arms, wherein each support arm is pivotally connected at one end to the support plate and pivotally connected at the other end to a support arm pivot disposed on each of the jaws, and wherein the jaw pivot is supported by the support plate.

The torque wrench may comprise a pair of opposing driving assemblies each comprising a motor, an upper drive pinion and a lower drive pinion, wherein each of the jaws comprises one of the driving assemblies.

The die assembly carrier may be interchangeable to accommodate tubulars of different diameters.

The torque wrench may be lockable in the closed position.

The bevel pinion carrier may comprise two C-shaped halves, wherein a terminal end of one of the halves comprise an upper collar and lower collar, and a terminal end of the other of the halves comprises a middle collar that interleaves between the upper collar and the lower collar when the wrench is in the closed position. Each of the upper, middle and lower collar may comprise an aperture coaxial with the apertures of the other collars when the wrench is in the closed position.

The torque wrench may comprise an upper lock assembly disposed on the upper collar, and a lower lock assembly disposed on the lower collar, each of the lock assemblies comprising a rotatable lock comprising at least one radial projection on one face and a threaded member extending from the other face; and a cylinder slidingly disposed in a corresponding one of the upper collar and the lower collar, the cylinder comprising a threaded member engaged with the threaded member of the corresponding rotatable lock, wherein the cylinder is restricted from rotating about its axis. A plurality of upper key assemblies may be disposed on the upper bevel gear, and a plurality of lower key assemblies disposed on the lower bevel gear, each of the key assemblies comprising a radial projection. The lock assemblies and key assemblies may be arranged such that rotation of the bevel gears relative to the bevel pinion carrier results in rotation of the rotatable locks due to engagement between the radial projections of the transiting key assemblies and the at least one radial projections of the stationary rotatable locks, whereby due to rotation of the rotatable locks, depending on rotational direction, the cylinders move out of the respective upper and lower collars into the middle collar to lock the wrench, or move out of the middle collar into their respective upper and lower collars to unlock the wrench.

The rotatable lock may comprise a first radial projection and a second radial projection 120 degrees apart from each other, and wherein in an initial unlocked position the second radial projection is oriented in alignment with an imaginary line radiating from the center of the wrench, and the first radial projection is oriented opposite the direction of rotation of bevel gear.

Four key assemblies may be disposed on each of the bevel gears, and the radial projections of the leading two upper key assemblies are oriented at an acute angle relative to an imaginary line radiating from the center of wrench, in the direction of rotation of the bevel gear, and the trailing two upper key assemblies are oriented at an acute angle relative to an imaginary line radiating from the center of wrench, opposite the direction of rotation of the bevel gear.

The key assemblies may be biased to rotate in the direction of the center of the wrench.

The foregoing discussion merely summarizes certain aspects of the inventions and is not intended, nor should it be construed, as limiting the inventions in any way.

BRIEF DESCRIPTION OF DRAWINGS

The accompanying drawings illustrate non-limiting example embodiments of the invention.

DETAILED DESCRIPTION OF THE INVENTION

Figure 1:
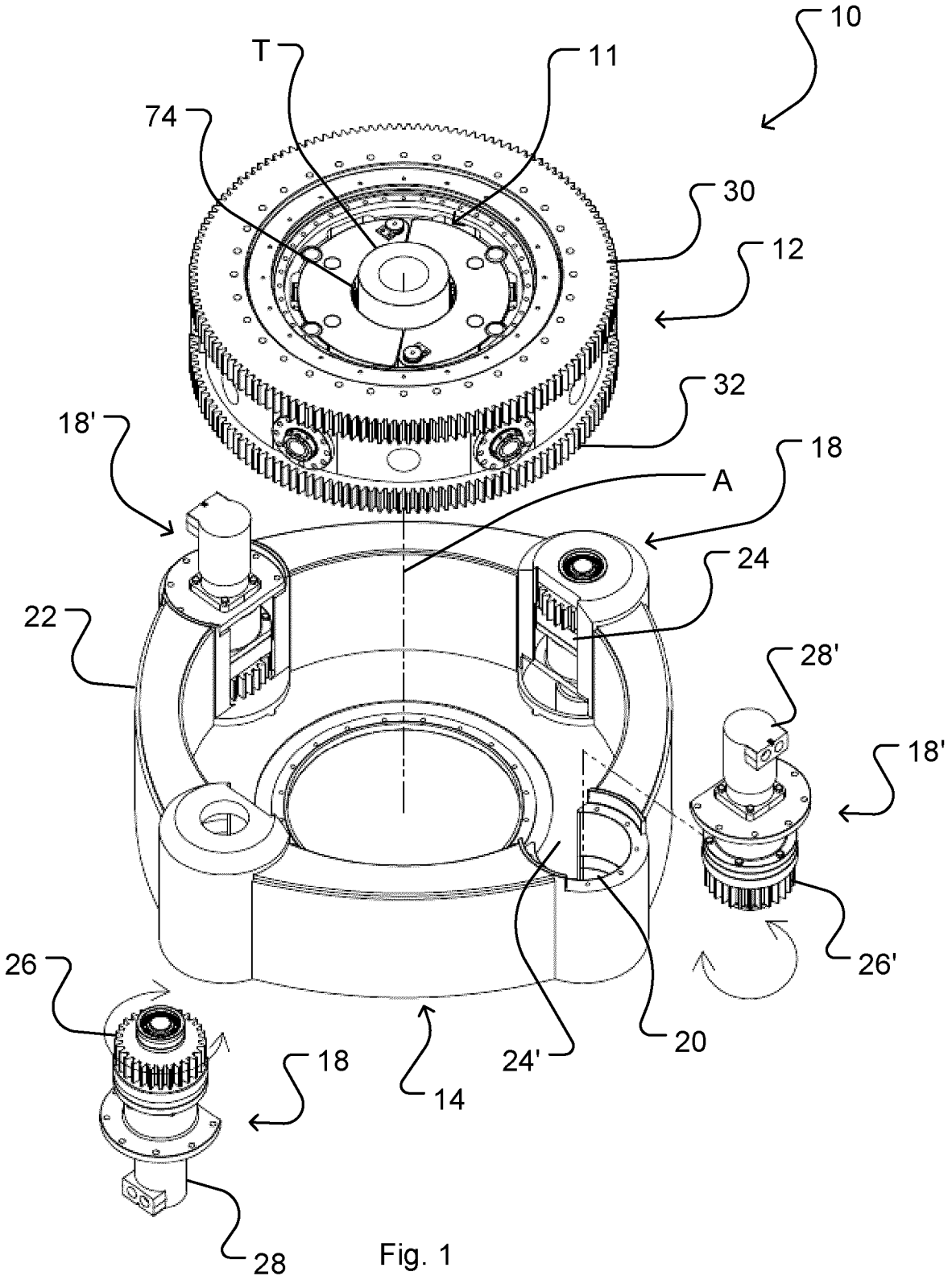
FIG. 1 is an isometric, partially exploded view of a torque wrench according to an embodiment.
Figure 2:
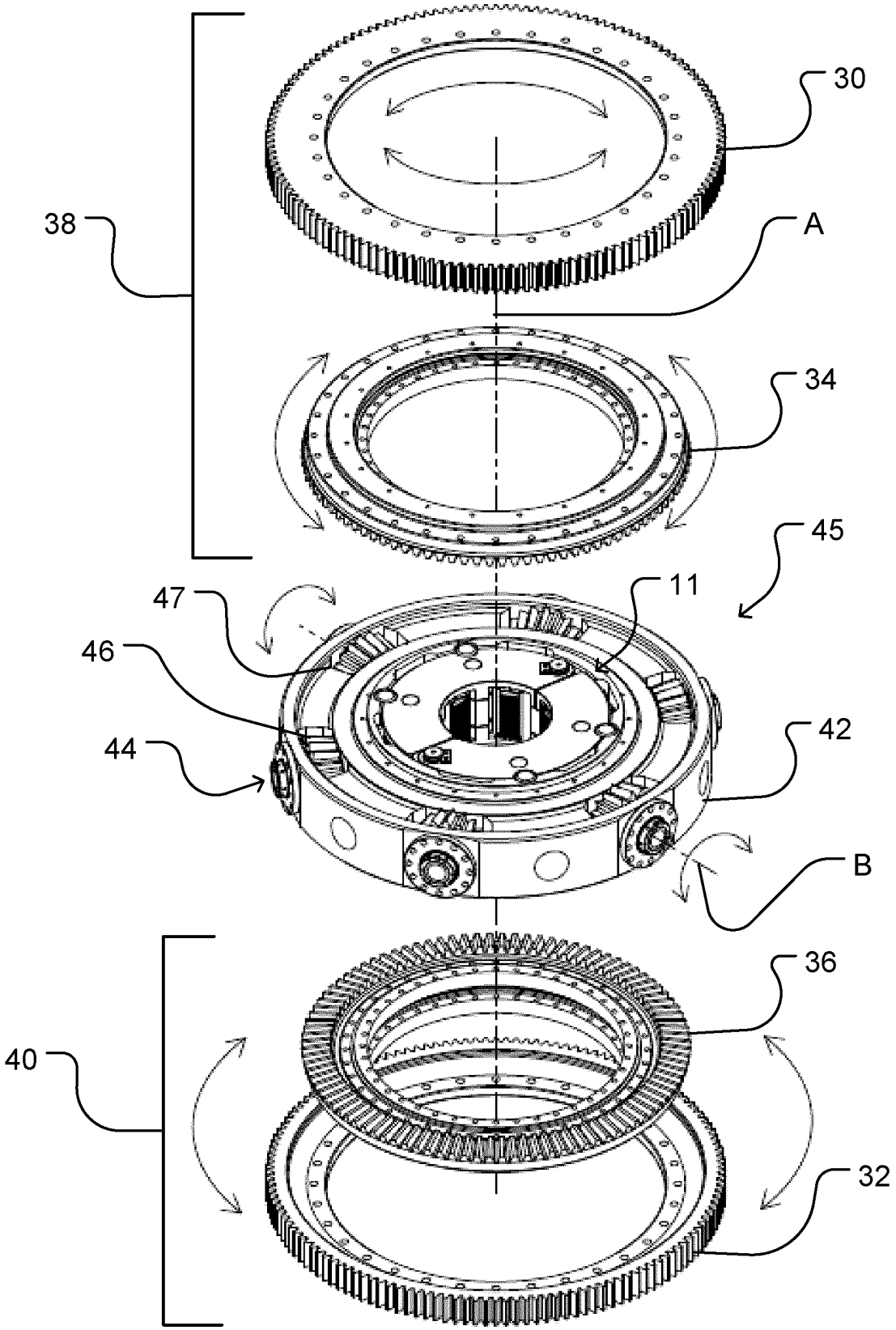
FIG. 2 is an isometric, partially exploded partial view of the embodiment shown in FIG. 1 showing the ring gears, the bevel-gears and the gripping assembly inside the bevel-pinion-carrier assembly.
Figure 3A:
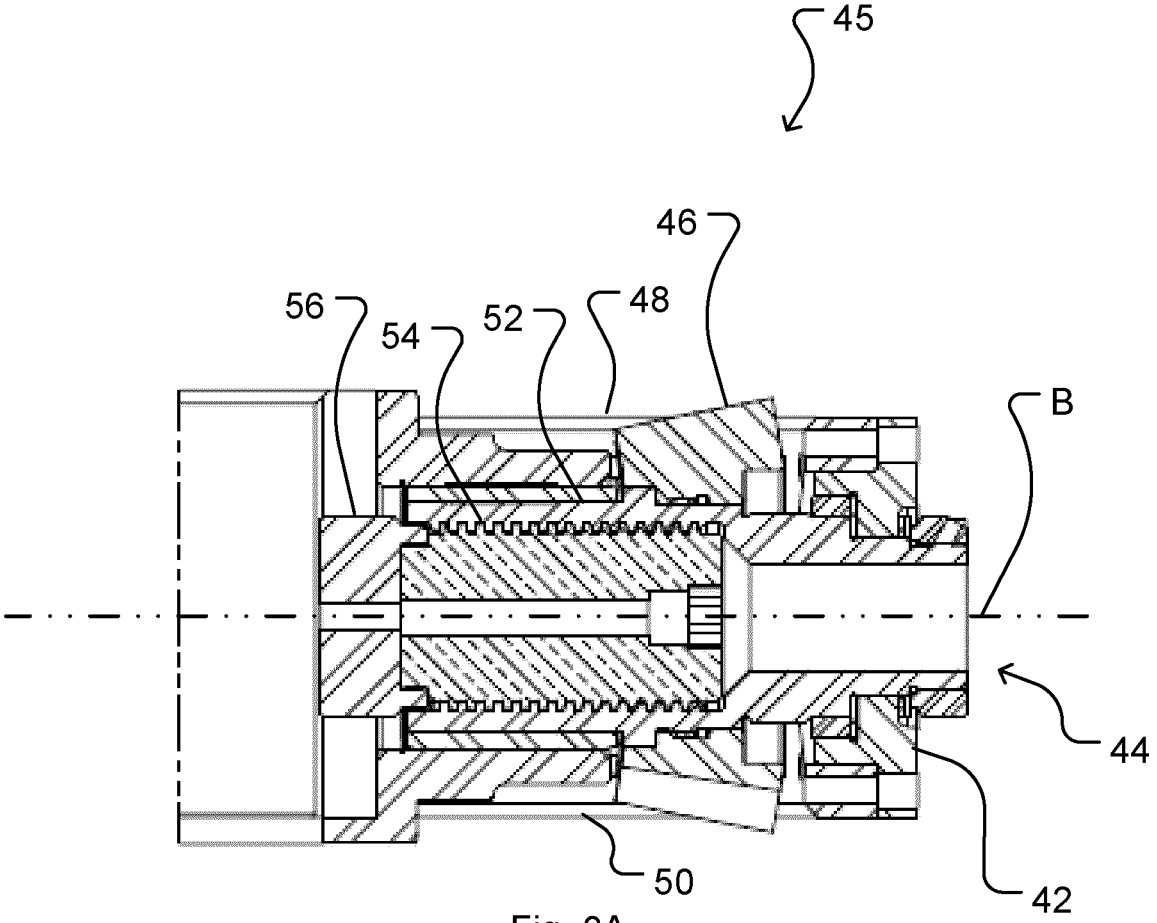
FIG. 3A is a partial cross-sectional view of the bevel-pinion-carrier assembly of the embodiment shown in FIG. 1, with the actuating rod in a retracted position.
Figure 3B:
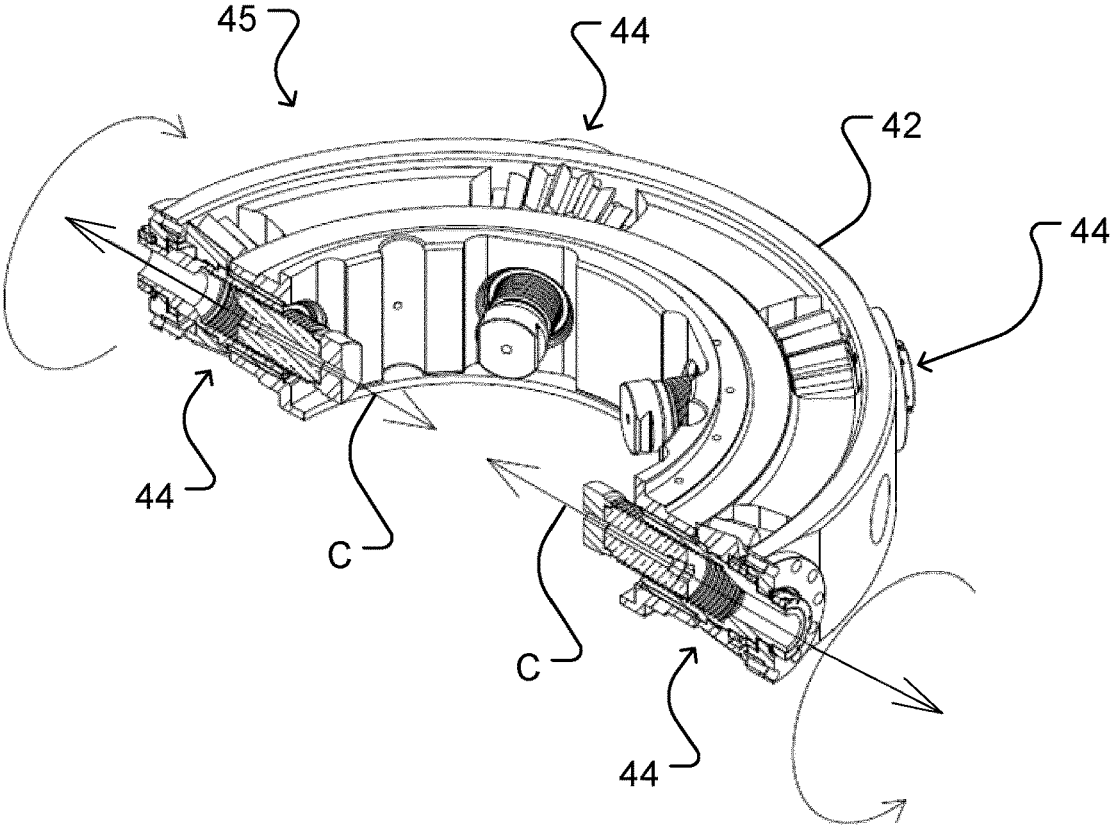
FIG. 3B is an isometric cross-sectional view of the bevel-pinion-carrier assembly of the embodiment shown in FIG. 1, with the actuating rods in an extended position.
Figure 3C:
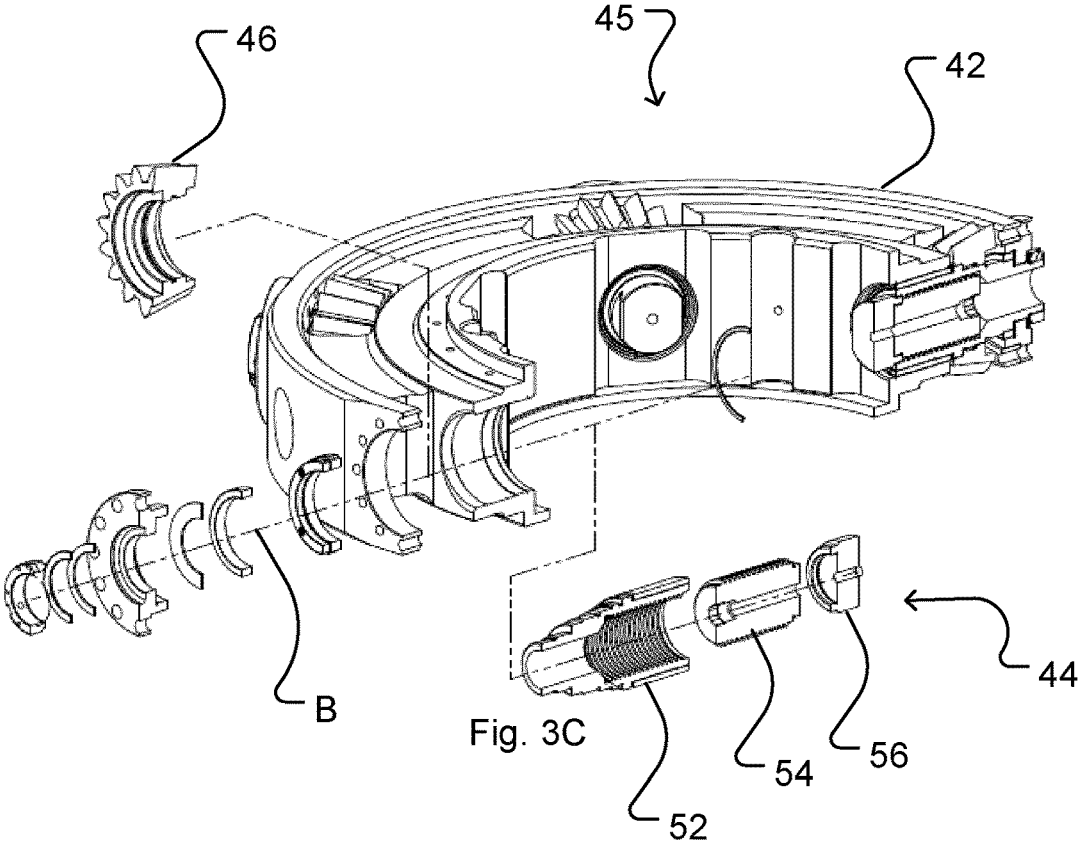
FIG. 3C is a partially exploded view of the bevel-pinion-carrier assembly shown in FIG. 3B.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

The term "rotatably connected" as used herein refers to direct meshing engagement between gears and indirect meshing connections between gears through a gear train.

The invention relates to torque wrenches. The specification describes the invention as applied to a particular application of torque wrenches, namely oilfield tubular torque wrenches, but it should be understood that the invention can be applied in any other application requiring high torque make-up and/or break-out of tubulars.

FIGS. 1 to 5 show a torque wrench 10 according to an embodiment of the invention. Torque wrench 10 includes a rotating assembly 12 rotatably mounted in an interior of a housing 14 by means of a support bearing 16 (as best shown in FIGS. 5A and 5B). Tubular T having an axis A is received in central aperture 74 of gripping assembly 11.

Opposing pairs of driving assemblies 18, 18' are mounted in respective slots 20 formed in sidewall 22 of housing 14. Each slot 20 has an opening 24 facing the interior of housing 14.

Each upper driving assembly 18 includes a drive pinion 26 driven by a motor 28. Drive pinions 26 are in meshing engagement, through openings 24, with an upper ring gear 30 of rotating assembly 12. Similarly, each lower driving assembly 18' includes a drive pinion 26' driven by a motor 28'. Drive pinions 26' are in meshing engagement, through openings 24, with a lower ring gear 32 of rotating assembly 12.

Upper ring gear 30 is fixedly connected to an upper bevel gear 34 to form an upper ring gear-bevel gear assembly 38. Similarly, lower ring gear 32 is fixedly connected to a lower bevel gear 36 to form a lower ring gear-bevel gear assembly 40. Fixed connection between ring gears 30, 32 and bevel gears 34, 36 may for example be by bolted connection.

Figure 5A:
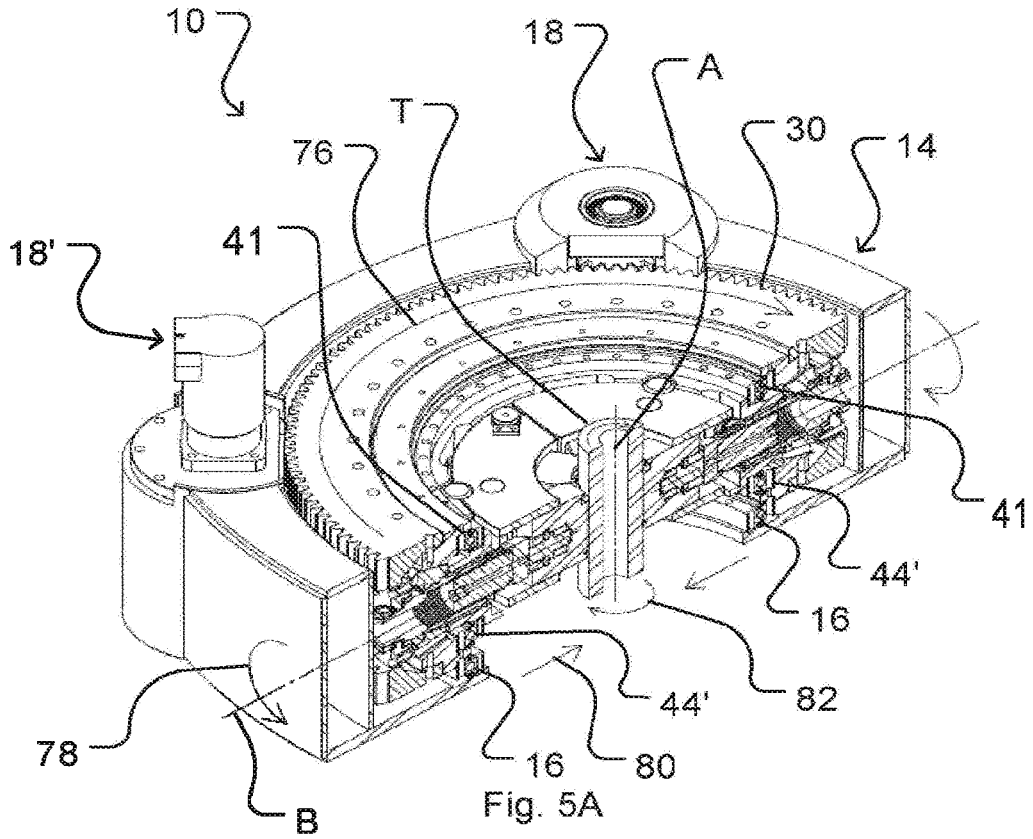
FIG. 5A is an isometric cross-sectional view of the embodiment shown in FIG. 1 during a make-up operation.
Figure 5B:
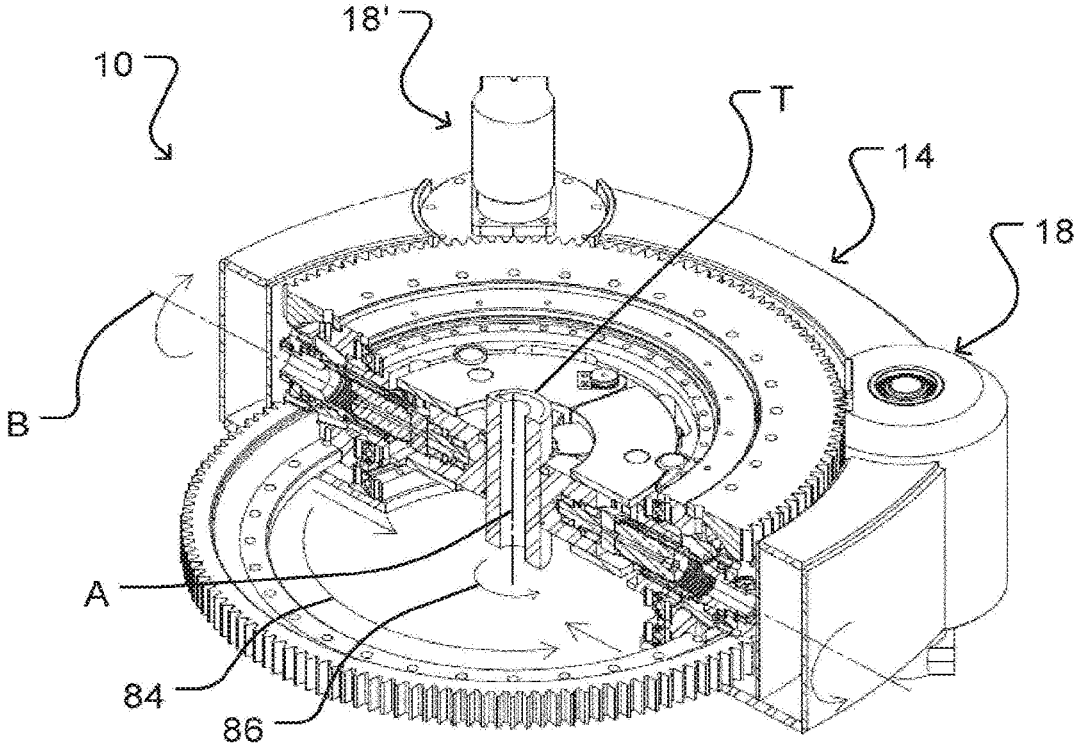
FIG. 5B is an isometric, partial cross-sectional view of the embodiment shown in FIG. 1 during a break-out operation.

Upper ring gear-bevel gear assembly 38 is disposed against an upper side 48 of a bevel pinion carrier 42 by a support bearing 41 (as best shown in FIGS. 5A and 5B). Similarly, lower ring gear-bevel gear assembly 40 is disposed against a lower side 50 of the bevel pinion carrier 42 by a support bearing 41' (as best shown in FIGS. 5A and 5B).

Bevel pinion carrier assembly 45 includes a plurality of bevel pinion assemblies 44 circumferentially mounted in bevel pinion carrier 42. Each bevel pinion assembly 44 includes a bevel pinion 46 protruding from both upper side 48 and lower side 50 of bevel pinion carrier 42. Each bevel pinion assembly 44 is rotatably mounted in bevel pinion carrier 42 such that each bevel pinion 46 can rotate about its axis B (perpendicular to the axis A of tubular T) but cannot substantially move otherwise in any direction relative to bevel pinion carrier 42.

Upper bevel gear 34 is in meshing engagement with the plurality of bevel pinions 46 through corresponding openings 47 in upper side 48 of bevel pinion carrier 42, and lower bevel gear 36 is similarly in meshing arrangement with the same plurality of bevel pinions 46 through corresponding openings (not shown) in lower side 50 of bevel pinion carrier 42.

Bevel pinion assembly 44 also includes a carrier 52 at least partially comprising a female thread. Each bevel pinion 46 is fixedly connected to carrier 52 such that they rotate together. Bevel pinion 46, through carrier 52, is threadably coupled to an actuating rod 54 with a male thread. The threaded coupling connection provides that, if actuating rod 54 is prevented from rotating about axis B, rotation of bevel pinion 46 will cause actuating rod 54 to move radially towards or away from tubular T. Actuating rod adapter 56 prevents rotation of actuating rod 54.

Gripping assembly 11 includes a plurality of die assemblies 61. Die assemblies 61 are slidably mounted and constrained within die assembly carriers 62 such that die assemblies 61 can only slide in radial directions C toward and away from tubular T along axis B. Each die assembly 61 includes at least one die 58 mounted on a die carrier 60. Actuating rod adapter 56 provides an interface between actuating rod 54 and die carrier 60.

Figure 4A:
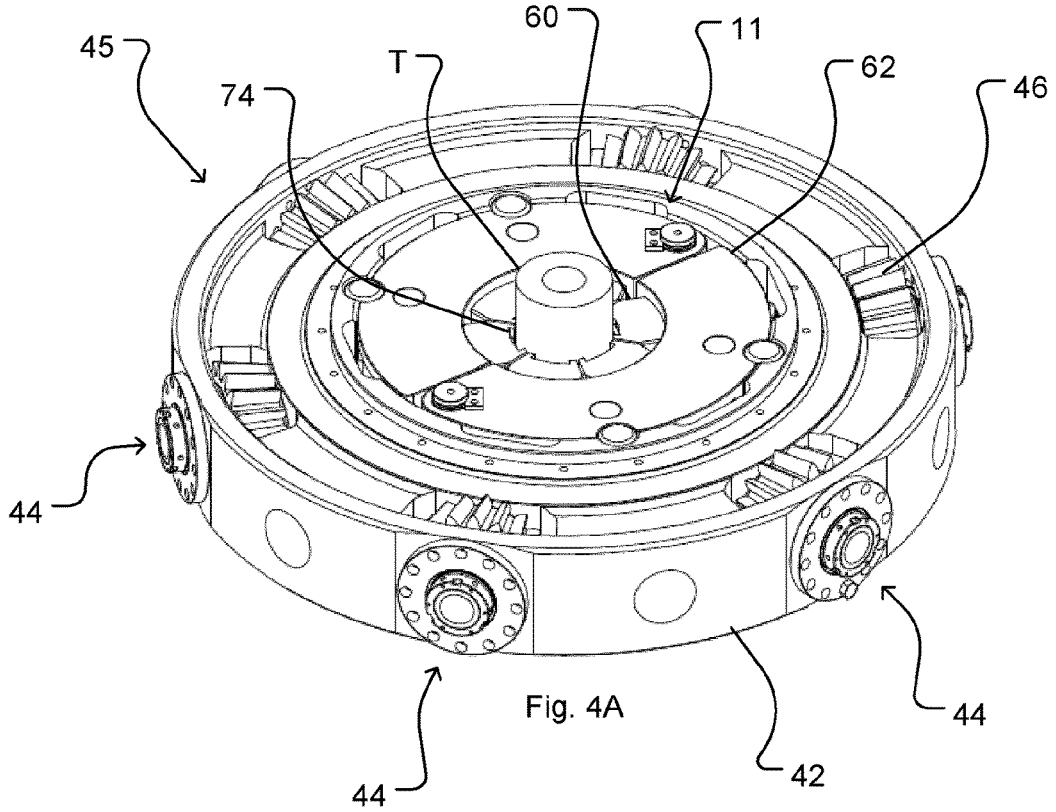
FIG. 4A is an isometric view of the gripping assembly and the bevel-pinion-carrier assembly of the embodiment shown in FIG. 1.
Figure 4B:
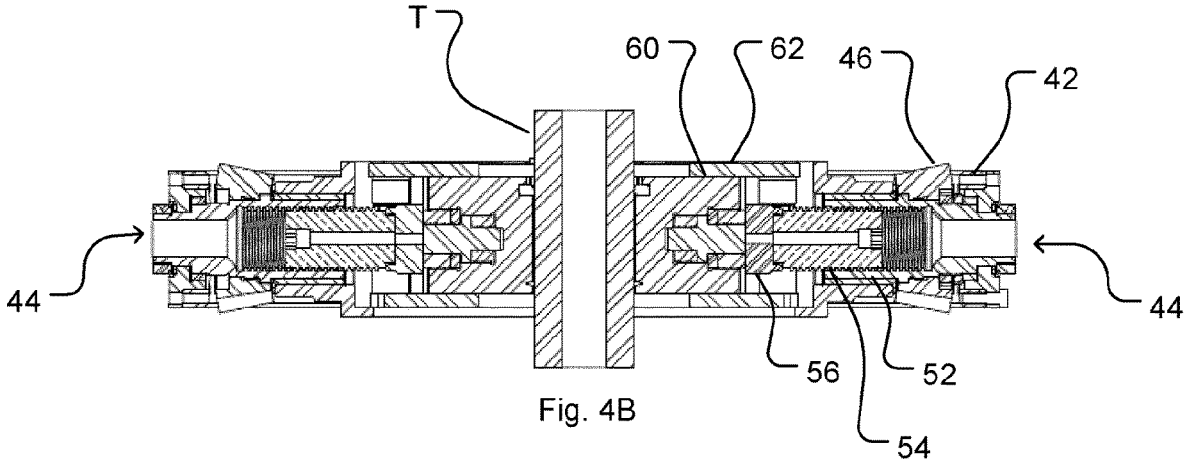
FIG. 4B is a cross-sectional view of the gripping assembly and the bevel-pinion-carrier-assembly of FIG. 4A.
Figure 4C:
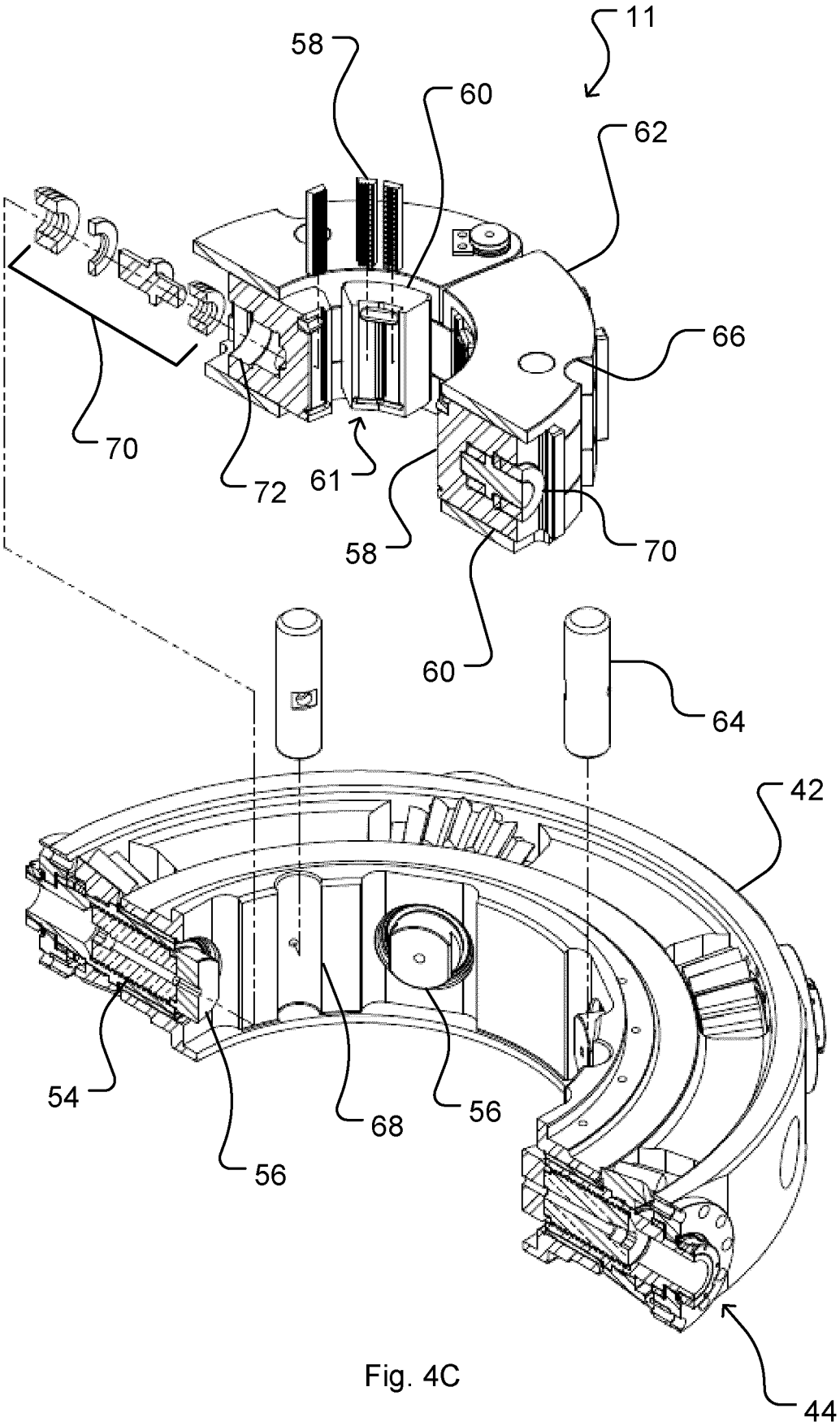
FIG. 4C is an isometric partially exploded cross-sectional view of the gripping assembly and the bevel-pinion-carrier assembly of the embodiment shown in FIG. 1, with the actuating rods in a retracted position.

A plurality of torque transfer pins 64 may be circumferentially disposed between die assembly carrier 62 and bevel pinion carrier 42, as shown best in FIG. 4C. To accommodate torque transfer pins 64, corresponding recesses 66, 68 are formed in die assembly carrier 62 and bevel pinion carrier 42, respectively.

To grip a tubular T, wrench 10 is positioned with tubular T extending through aperture 74 and with die assemblies 61 in a retracted position. Motors 28 rotate drive pinions 26 of upper driving assembly 18 in a first direction (e.g. counter-clockwise viewed from above), to drive upper ring gear 30 in a second direction (e.g. clockwise viewed from above, as indicated by arrow 76 in FIG. 5A), in turn to cause upper bevel gear 34 to rotate at the same speed and in the same direction as upper ring gear 30. Due to the differential meshing arrangement among upper bevel gear 34, lower bevel gear 36 and bevel pinions 46, bevel pinion assemblies 44 rotate about their respective axes (i.e., axes B) in a first direction (e.g. counter-clockwise direction looking towards tubular T, as indicated by arrow 78 in FIG. 5A) while bevel pinion carrier 42 remains stationary about its own axis (i.e., axis A). If carriers 52 and actuating rods 54 feature right-hand thread (typical in industry) rotation of bevel pinion assemblies 44 causes actuator rods 54 and associated die assemblies 61 to move radially inward towards tubular T, as indicated by arrow 80 in FIG. 5A. Motors 28' of lower driving assemblies 18' for lower ring gear 32 may remain idle.

Gripping tubular T may be also achieved by having motors 28' rotate drive pinions 26' of lower driving assembly 18' in a second direction (e.g. clockwise viewed from above), to drive lower ring gear 32 in a first direction (e.g. counter-clockwise viewed from above), in turn to cause lower bevel gear 36 to rotate at the same speed and in the same direction as lower ring gear 32. Due to the differential meshing arrangement among upper bevel gear 34, lower bevel gear 36 and bevel pinions 46, bevel pinion assemblies 44 rotate about their respective axes (i.e., axes B) in a first direction (e.g. counter-clockwise direction looking towards tubular T, as indicated by arrow 78 in FIG. 5A) while bevel pinion carrier 42 remains stationary about its own axis (i.e., axis A). If carriers 52 and actuating rods 54 feature right-hand thread (typical in industry) rotation of bevel pinion assemblies 44 causes actuator rods 54 and associated die assemblies 61 to move radially inward towards tubular T, as indicated by arrow 80 in FIG. 5A. Motors 28 of upper driving assemblies 18 for upper ring gear 30 may remain idle.

Gripping tubular T may be further achieved by synchronizing motors 28 of driving assembly 18 to rotate drive pinions 26/upper ring gear 30/upper bevel gear 34, and motors 28' of driving assembly 18' to rotate drive pinions 26'/lower ring gear 32/lower bevel gear 36 in the manner described above. Bevel pinion carrier 42 remains stationary about its own axis (i.e., axis A). The sum of torques acting on bevel pinion carrier 42 will be essentially zero as long as there is no significant resistance to die assemblies 61 moving towards tubular T.

Once die assemblies 61 make contact with tubular T, movement toward tubular T is no longer possible. In the case of synchronized powering by motors 28, 28', spinning resistance of bevel pinions 46 will increase, triggering a pressure spike in motors 28, 28'. Continued synchronized powering by motors 28, 28' will exert, through bevel pinion assemblies 44, a higher gripping force on tubular T but without producing any significant torque on bevel pinion carrier 42.

Because die assemblies 61 moving toward tubular T occurs while bevel pinion carrier 42 is stationary about its own axis (i.e., axis A), contact between die assemblies 61 and tubular T occurs under static (i.e., rotation-free) conditions, eliminating the possibility of damage to tubular T.

Tubular T can be made up once die assemblies 61 are in contact with tubular T. Due to the differential meshing arrangement among upper bevel gear 34, lower bevel gear 36 and bevel pinions 46, bevel pinions 46 are stationary about their own axes (i.e., axis B) because die assemblies 61 are in contact with tubular T, and due to the resistance of bevel pinions 46 to rotate, bevel pinion carrier 42 rotates about its own axis (i.e., axis A) when the ring gears/bevel gears are driven. Driving assemblies 18 driving upper ring gear 30 in a second direction (e.g. clockwise viewed from above), forces entire rotating assembly 12 to rotate in the second direction, thereby rotating gripped tubular T in the second direction (e.g. clockwise viewed from above, as indicated by arrow 82 in FIG. 5A) for make up. The gripping force acting between die assemblies 61 and tubular T is a reaction to the torque acting on upper ring gear 30 and is, consequently, fully proportional to the torque (when adjusted for frictional losses in the system). Motors 28' of driving assemblies 18' for lower ring gear 32 are idled during the foregoing make up operation.

To break out tubular T, motors 28 of driving assemblies 18 for upper ring gear 30 are idled, and motors 28' of driving assemblies 18' drive lower ring gear 32 in a first direction (e.g. counter-clockwise viewed from above, as indicated by arrow 84 in FIG. 5B). This forces entire rotating assembly 12 to rotate in the first direction, and thereby rotating gripped tubular T in the first direction (e.g. counter-clockwise viewed from above, as indicated by arrow 86 in FIG. 5B) for break out. Again, the gripping force acting between die assemblies 61 and tubular T is a reaction to the torque acting on lower ring gear 32 and is, consequently, fully proportional to the torque (when adjusted for frictional losses in the system).

To release tubular T, driving upper ring gear 30 in the first direction and/or driving lower ring gear 32 in the second direction will cause die assemblies 61 to retract from tubular T while bevel pinion carrier 42 remains stationary.

As can be appreciated by a person skilled in the art, any combination of rotation speeds of drive pinions 26, 26' to rotate upper bevel gear 34, lower bevel gear 36 and bevel pinions 46 is possible and can be used to control various phases of operation of wrench 10. Also, the examples and directions of rotations described above will be reversed if the carriers with threaded interior 52 and the associated actuating rods 54 feature left-hand thread.

Both make up and break out operations are achieved by using the gripping force as the reaction to creating torque. Spinning torque cannot be produced without having a grip on tubular T, and spinning torque and the gripping force are pre-determined as a function of: the diameter and the size/number of teeth of the ring gears, bevel gears and pinions; the pitch and the diameters (major, minor, pitch) of the threads of carrier 52/actuating rod 54; and friction between the foregoing and other components of wrench 10.

FIGS. 6 to 19 show a torque wrench 100 according to another embodiment. While sharing many similar features and functions with wrench 10, wrench 100 can conveniently open and close around a tubular T.

Figure 6:
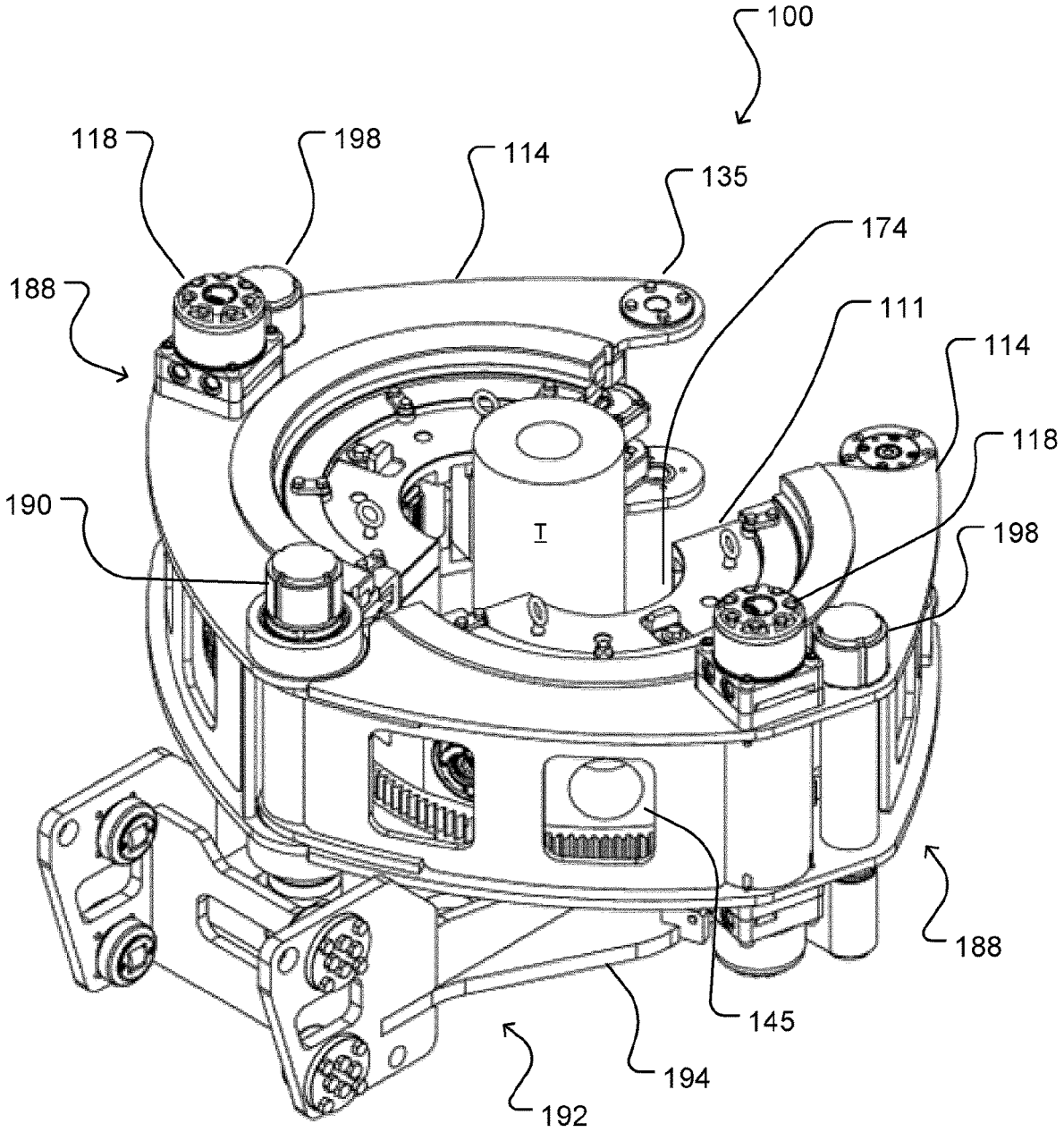
FIG. 6 is an isometric view of a torque wrench according to another embodiment, in an open position.
Figure 7:
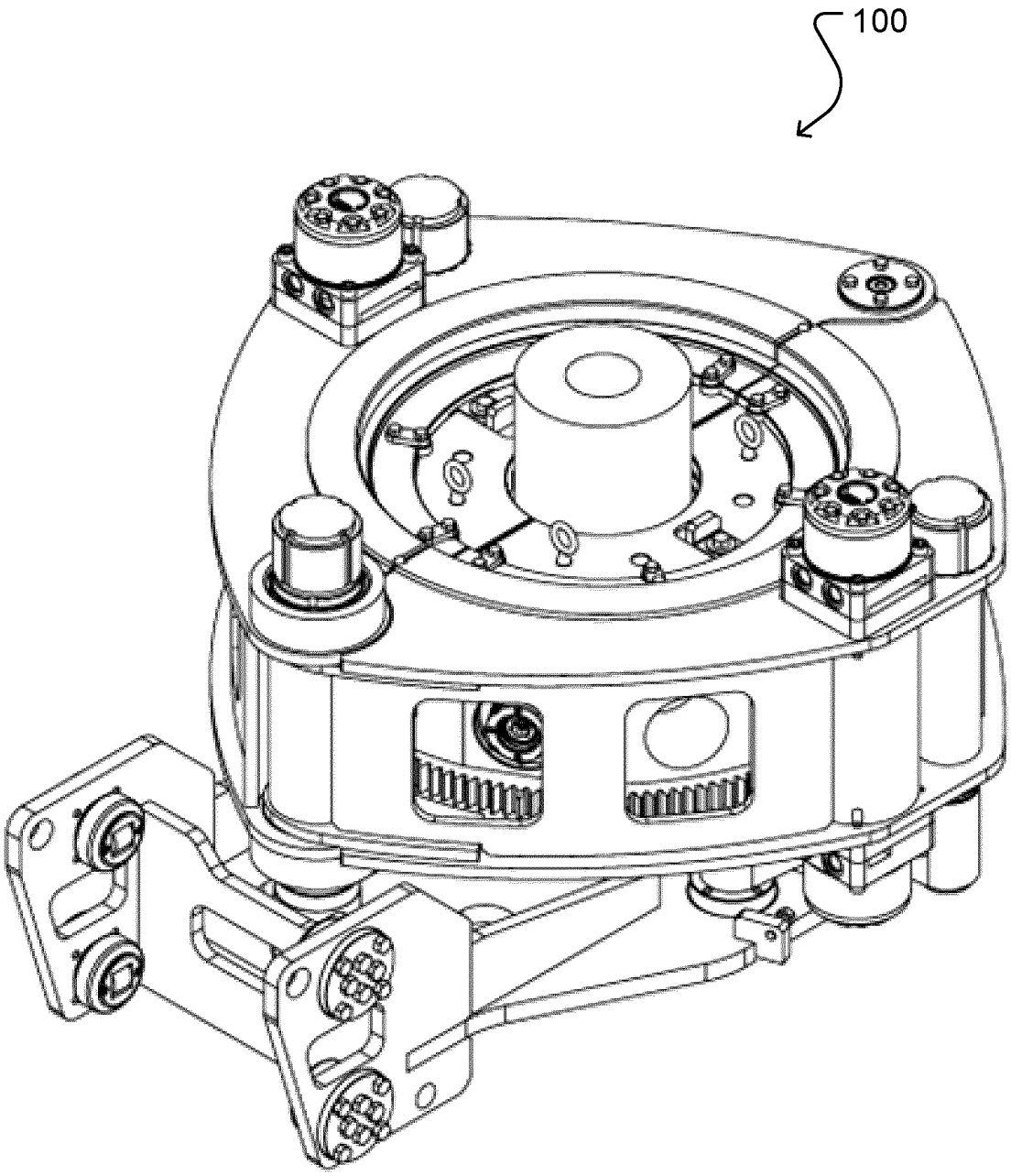
FIG. 7 is an isometric view of the embodiment shown in FIG. 6, in a closed position.
Figure 8:
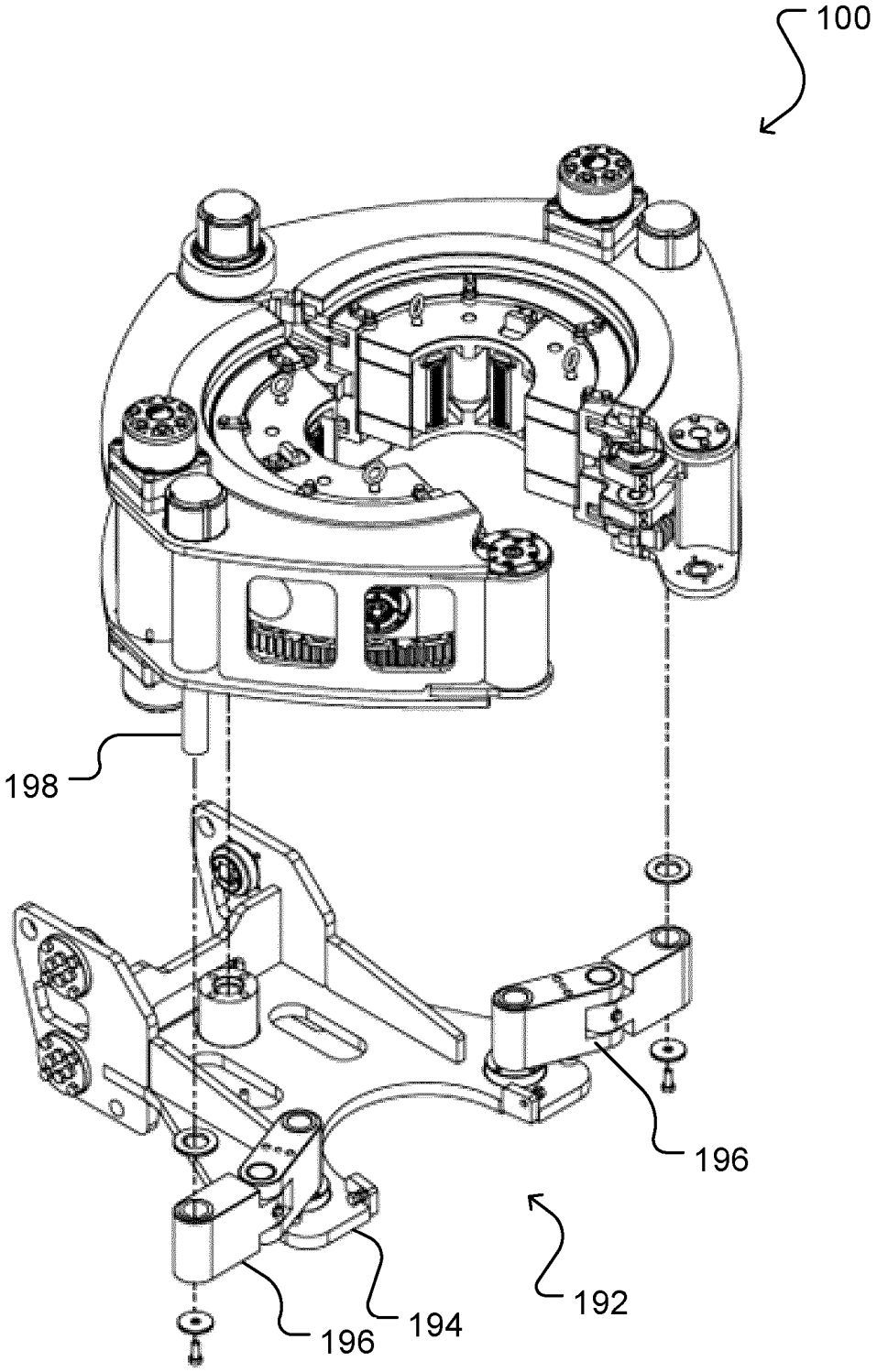
FIG. 8 is an isometric, partially exploded view of the embodiment shown in FIG. 6, showing details of the support assembly.
Figure 9:
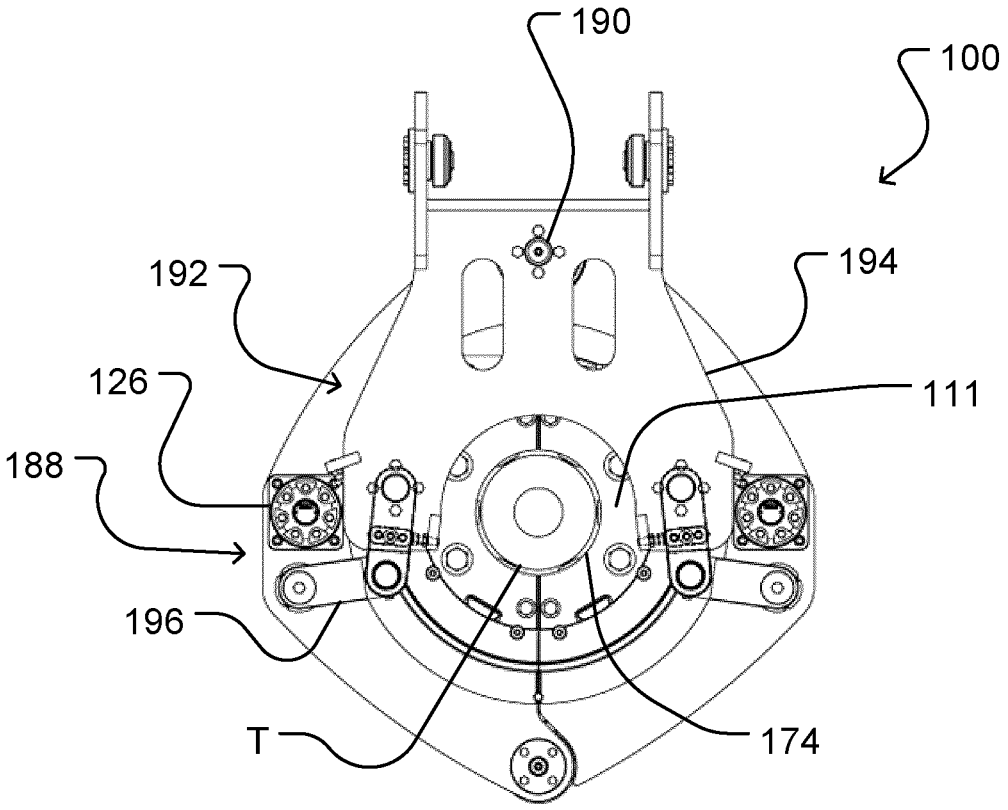
FIG. 9 is a bottom plan view of the embodiment shown in FIG. 6, in a closed position.
Figure 10:
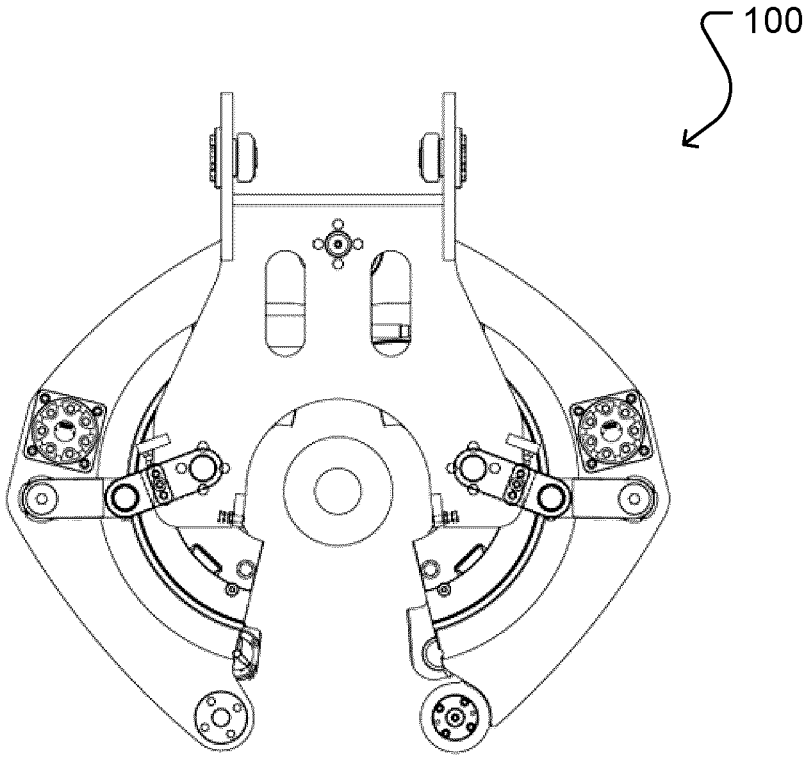
FIG. 10 is a bottom plan view of the embodiment shown in FIG. 6, in an open position.
Figure 11:
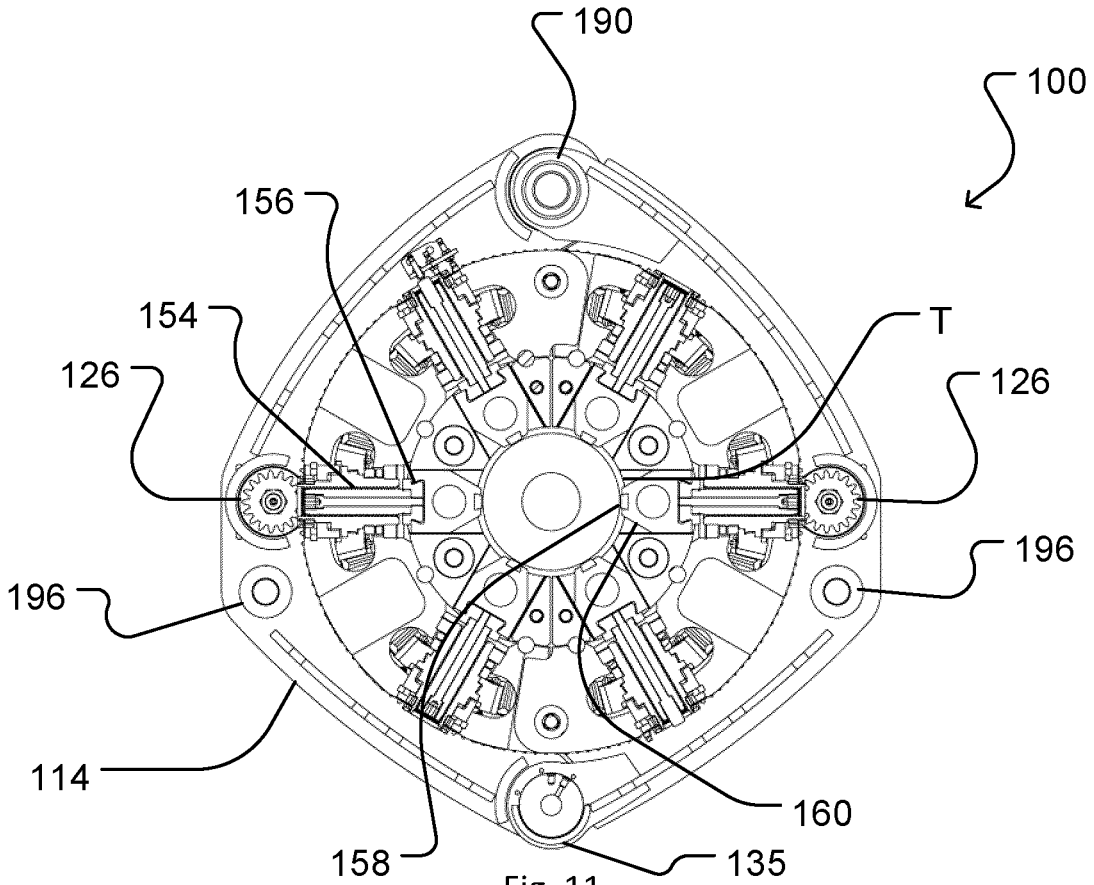
FIG. 11 is a horizontal cross section view of the embodiment shown in FIG. 6, in a closed position.
Figure 12:
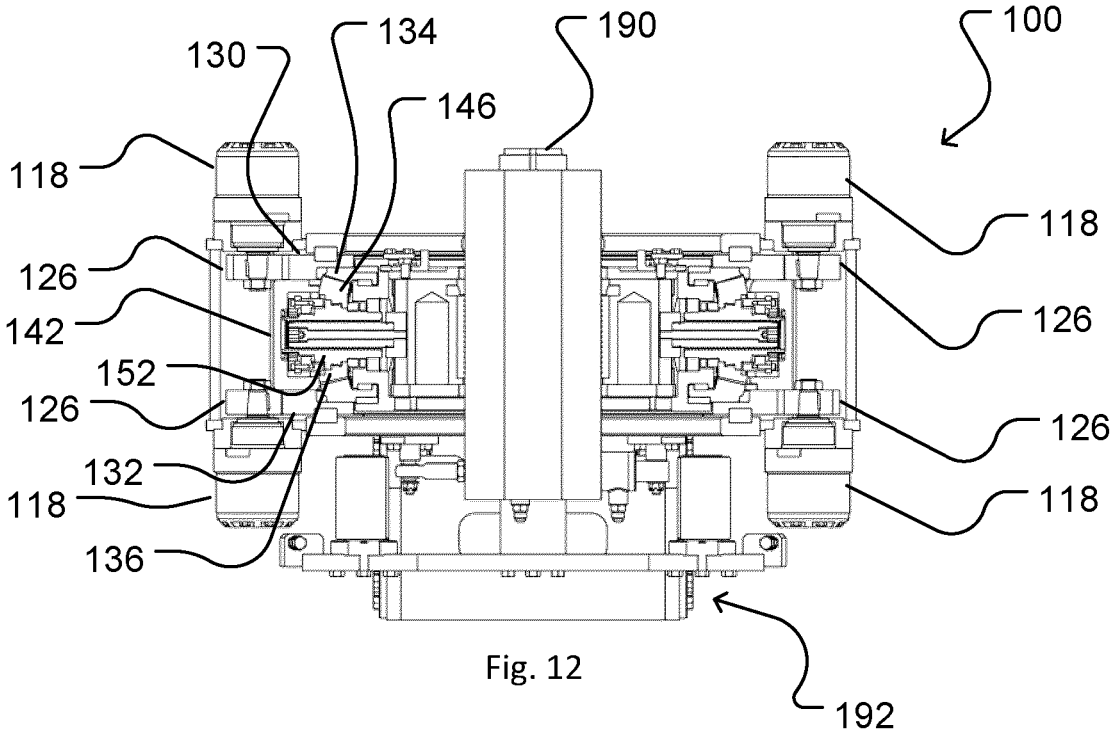
FIG. 12 is a vertical cross section view of the embodiment shown in FIG. 6, in a closed position.

As shown for example in FIGS. 6 and 7, wrench 100 is split into two C-shaped jaws 188 pivotally mounted at jaw pivot 190. Suitable means to open and close jaws 188 may for example be located within jaw pivot 190 or externally. Each jaw 188 includes respective C-shaped halves of a rotating assembly 112 (and therefore C-shaped halves of upper bevel gear 134, lower bevel gear 136, upper ring gear 130, lower ring gear 132, upper ring gear-bevel gear assembly 138, lower ring gear-bevel gear assembly 140, bevel pinion carrier 142 and bevel pinion carrier assembly 145) and housing 114. Jaws 188 close at closure 135.

Wrench 100 has four driving assemblies 118 distributed in two coaxial pairs of upper and lower driving assemblies. As shown best in FIGS. 11 and 12, each driving assembly 118 has a drive pinion 126. An upper pair of drive pinions 126 drives upper ring gear 130 to thereby rotate upper bevel gear 134. A lower pair of drive pinions drives lower ring gear 132 to thereby rotate lower bevel gear 136.

Figure 22:
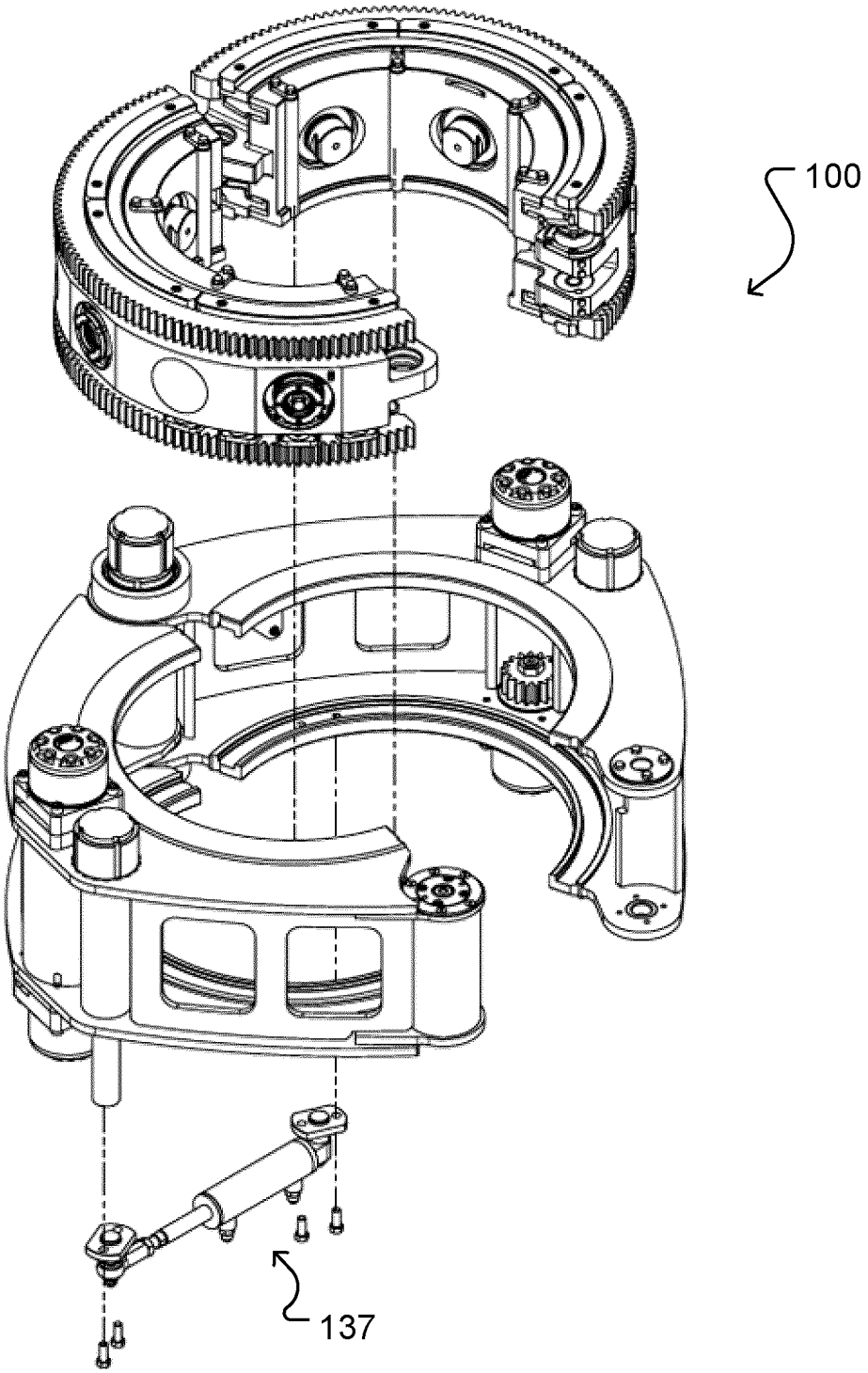
FIG. 22 is a partially exploded isometric view of a torque wrench according to another embodiment, in an open position.

To support the weight of wrench 100 and to facilitate opening and closing of jaws 188, wrench 100 is mounted on a support assembly 192. As shown best in FIGS. 8 to 10, support assembly 192 includes a support plate 194. Mounted on support plate 194 are jaw pivot 190 and two articulated support arms 196. The other end of each support arm 196 is pivotally connected to a corresponding support arm pivot 198 of wrench 100. An alternative embodiment is shown in FIG. 22, wherein a hydraulic cylinder 137 joins jaws 188, and in some embodiments may also serve as an actuator for opening and closing jaws 188.

Figure 13:
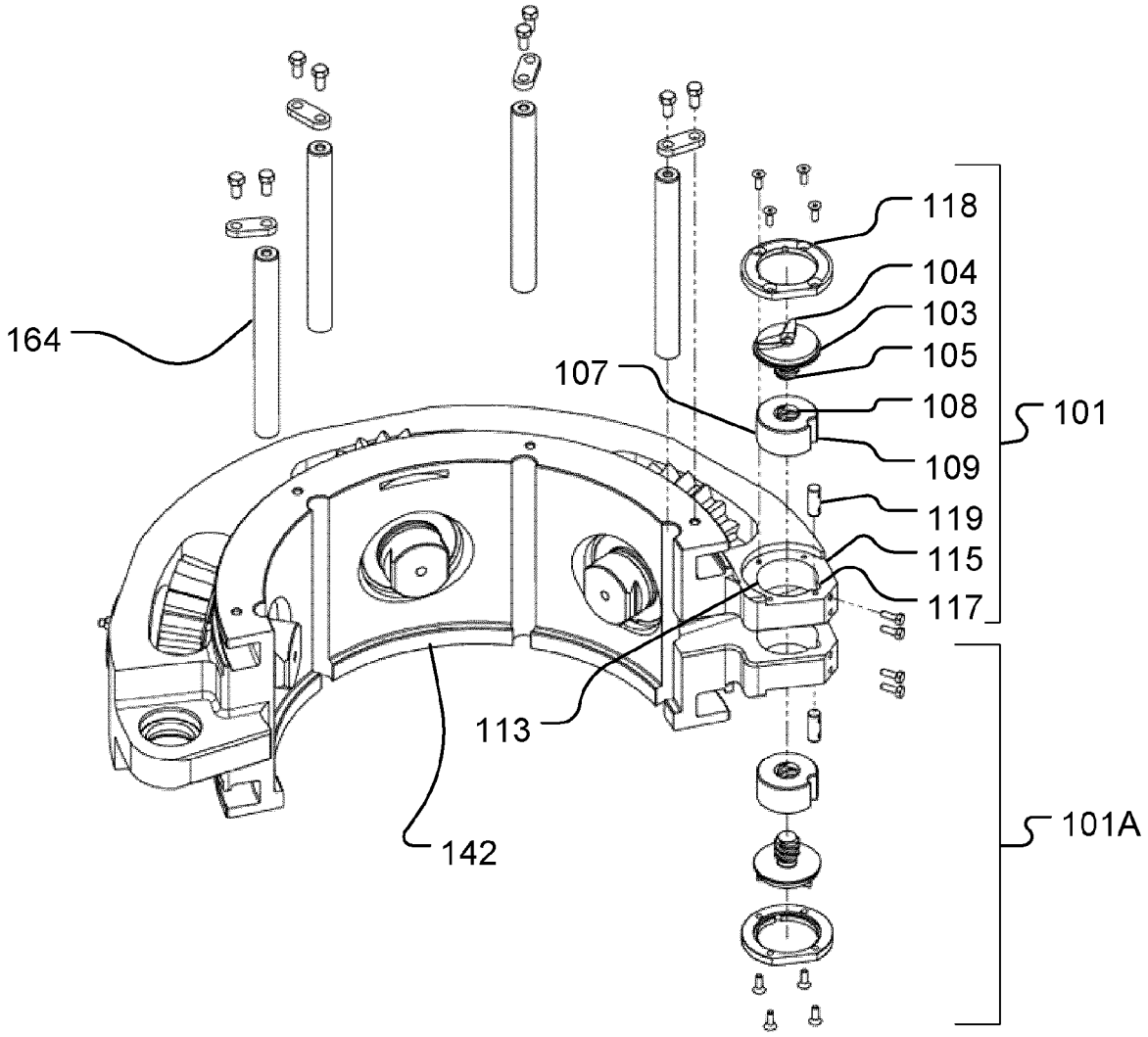
FIG. 13 is a partially exploded isometric view of one of the C-shaped halves of the bevel pinion carrier of the embodiment shown in FIG. 6, showing the components of the upper and lower lock assemblies in detail.

In some embodiments, wrench 100 comprises a locking mechanism which will now be described. Jaw 188 includes a pair of C-shaped halves of a bevel pinion carrier 142, and one of these C-shaped halves terminates in upper and lower collars at closure end 135. The upper collar 115 forms part of an upper lock assembly 101, and the lower collar forms part of a lower lock assembly 101A. The lock assemblies are identical, with the upper lock assembly 101 oriented upwards and the lower lock assembly 101A oriented downwards, as best shown in FIG. 13.

Upper lock assembly 101 includes a lock 103 rotatably mounted between hold down ring 118 which is fixed to collar 115. Lock 103 includes on one face two radial projections 104, 104' angled 120 degrees apart and on the other face a male thread 105. Male thread 105 engages female threads 108 of cylinder 107. In some embodiments lock 103 may be provided with a female thread and the cylinder a male thread. Cylinder 107 is slidingly disposed in collar 115. A pin 119 is received in a groove 109 of cylinder 107 and partially disposed in groove 117 of collar 115. The portion of pin 119 protruding from groove 117 thereby prevents rotation of cylinder 107 in collar 115, so that rotation of lock 103 is translated, through engagement of male thread 105 and female thread 108, into vertical movement of cylinder 108 in collar 115.

Figure 14:
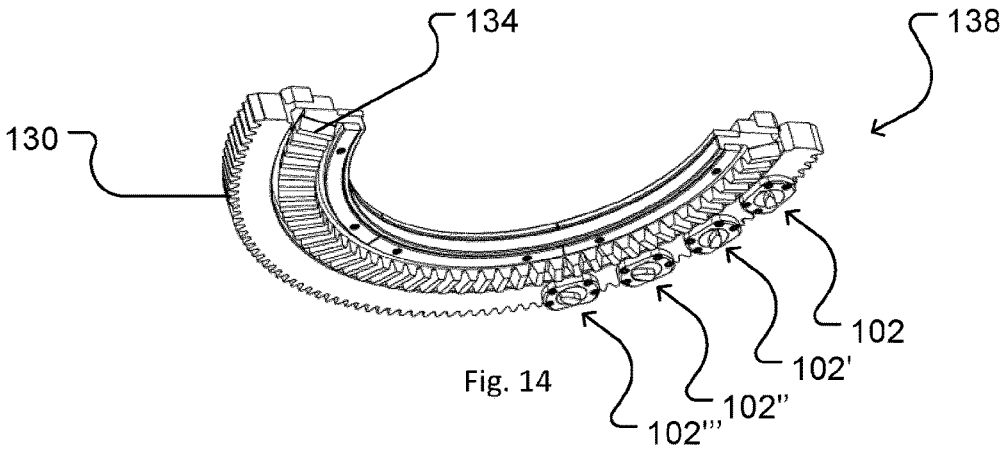
FIG. 14 is a bottom perspective view of one of the C-shaped halves of the ring gear-bevel gear assembly of the embodiment shown in FIG. 6.
Figure 15:
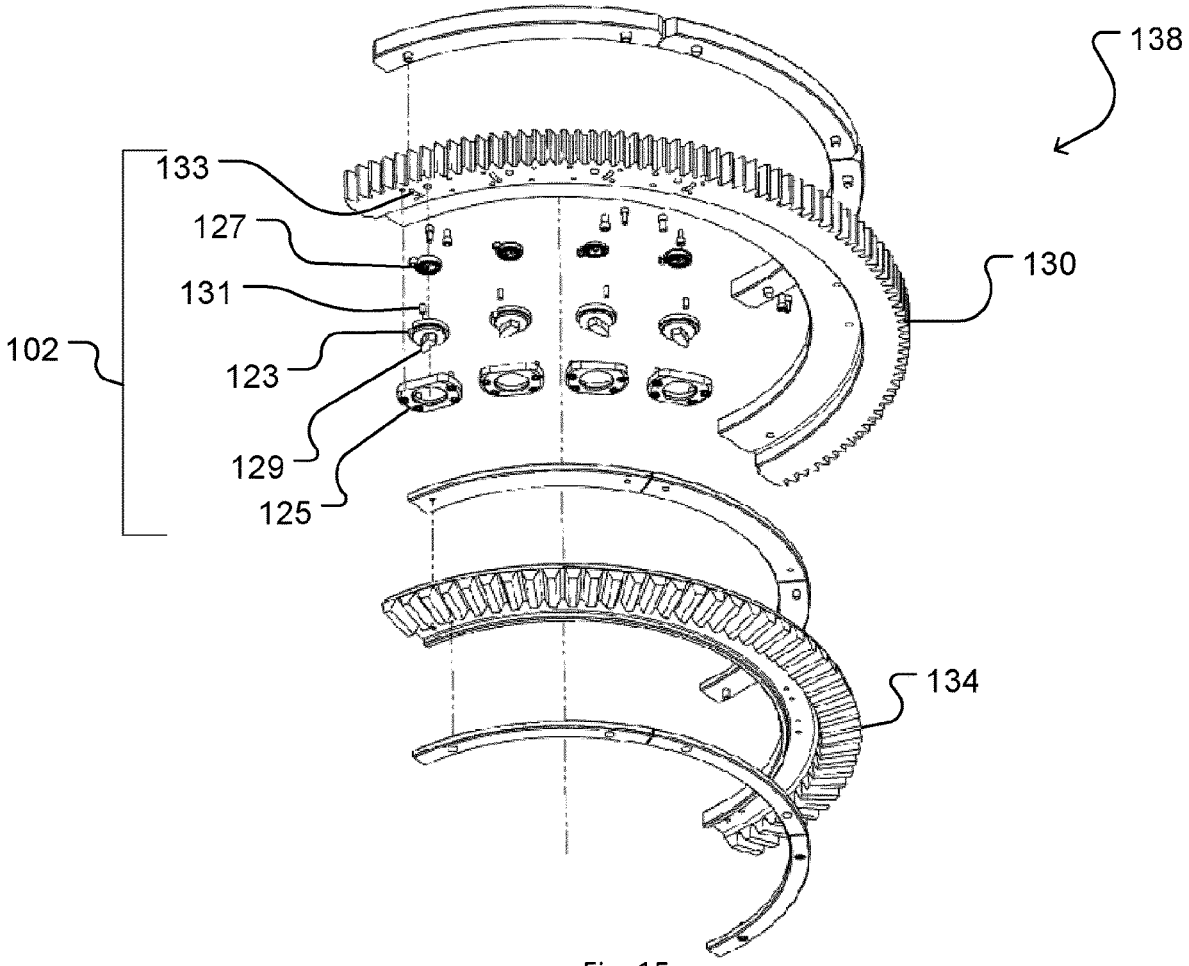
FIG. 15 is an exploded bottom perspective view of one of the C-shaped halves of the ring gear-bevel gear assembly of the embodiment shown in FIG. 6, showing the components of the key assemblies in detail.

As shown in FIG. 14, upper ring gear 130 of upper ring gear-bevel gear assembly 138 has disposed on its lower surface a plurality of upper key assemblies 102, 102', 102", 102'''. As shown in FIG. 15, each key assembly 102 comprises a key 123 rotatably mounted between a hold down ring 125 and upper ring gear 130. Key 123 has a radial projection 129 on one face (in this case the lower face) and a pin 131 connected to the opposite face in a location corresponding to radial projection 129. Rotation of key 123 is constrained by pin 131 which fits within groove 133 of upper ring gear 130. A spring 127 between key 123 and upper ring gear 130 provides a rotational bias of key 123 toward an imaginary center of ring gear 130.

FIGS. 16 to 19 illustrate the interaction between lock assemblies 101 and key assemblies 102 to lock wrench 100 once wrench 100 is in a closed position.

Figure 16A:
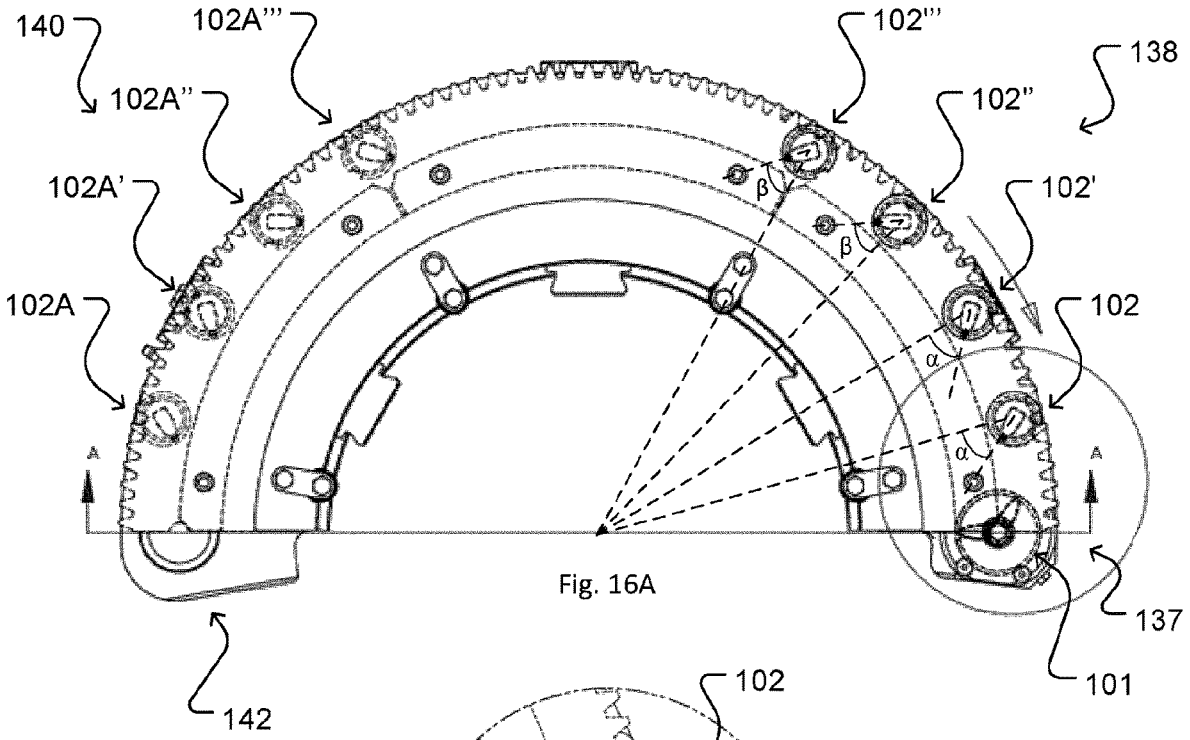
FIG. 16A is a partially see-through top plan view of one of the C-shaped halves of the rotating assembly of the embodiment shown in FIG. 6, in an unlocked configuration.
Figure 16B:
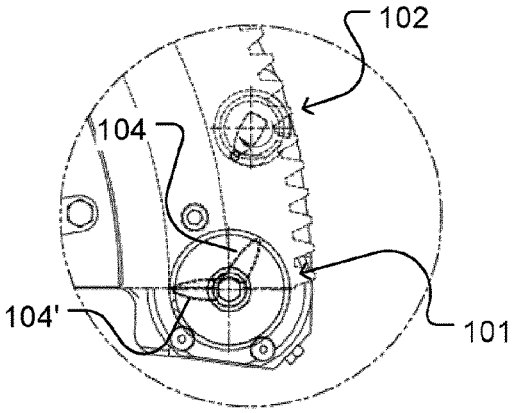
FIG. 16B is a close up of the circled portion in FIG. 16A, showing the lock assembly and one of the key assemblies.
Figure 16C:
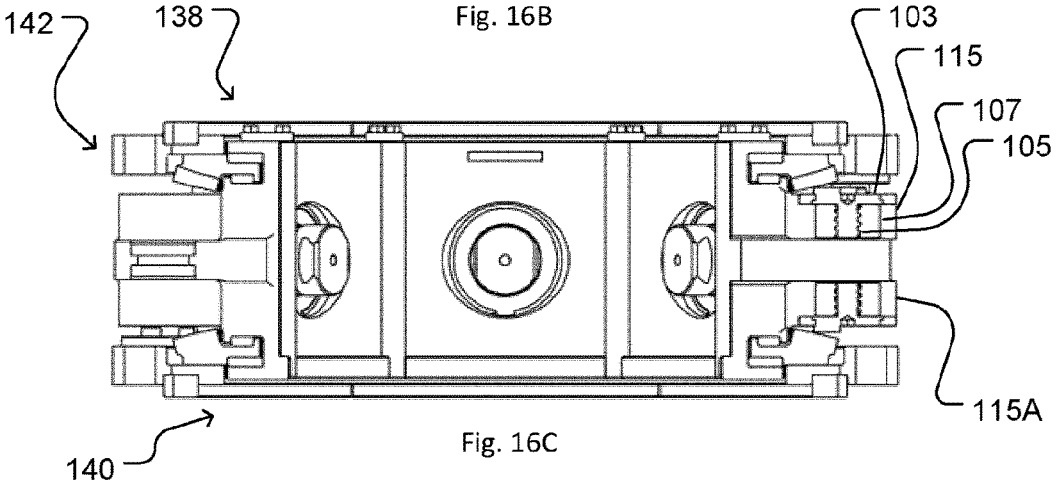
FIG. 16C is a vertical cross-section view taken along plane A-A of FIG. 16A.

FIG. 16A to 16C show wrench 100 in a closed and unlocked position. To initiate locking, upper ring gear-bevel gear assembly 138 is rotated clockwise to bring upper key assemblies 102, 102', 102", 102''' sequentially past upper lock assembly 101. As shown in FIG. 16A the radial projections 129 of leading two upper key assemblies 102, 102' are oriented at an acute angle $\alpha$, relative to an imaginary line radiating from the center of wrench 100, in the direction of rotation, and the trailing two upper key assemblies 102", 102''' are oriented at an acute angle $\beta$, relative to an imaginary line radiating from the center of upper ring gear-bevel gear assembly 138, opposite the direction of rotation. Also as shown in FIG. 16A, second radial projection 104' of upper lock assembly 101 is oriented in alignment with an imaginary line radiating from the center of wrench 100, and first radial projection 104 is oriented opposite the direction of rotation of upper ring gear-bevel gear assembly 138. As shown in FIG. 16C, in the initial position of upper lock assembly 101 shown in FIGS. 16A and 16B cylinder 107 of upper lock assembly 101 does not extend below the lower surface of upper collar 115.

Figure 17A:
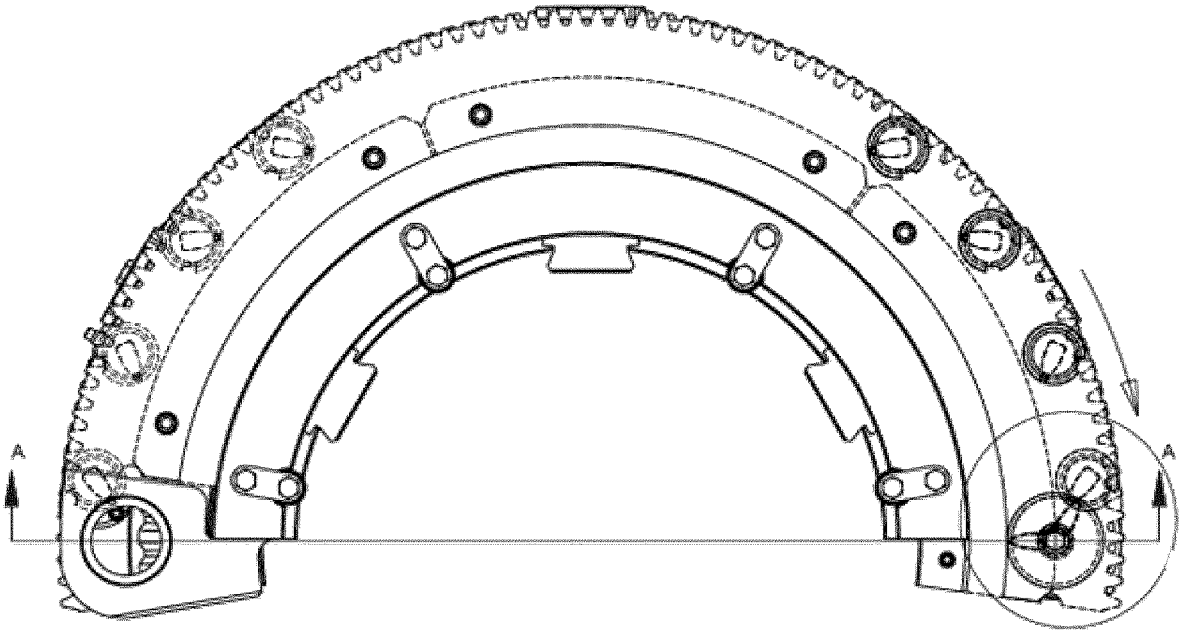
FIG. 17A is a partially see-through top plan view of one of the C-shaped halves of the rotating assembly of the embodiment shown in FIG. 6, in an unlocked configuration.
Figure 17B:
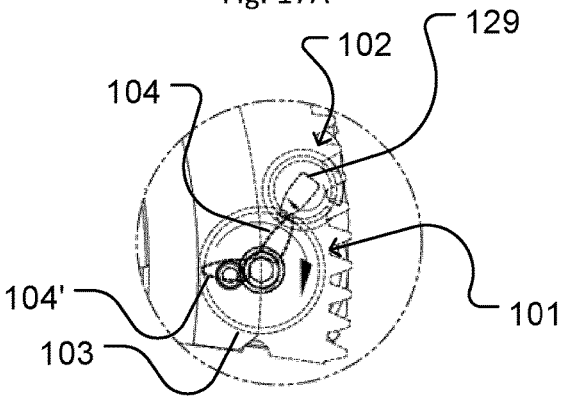
FIG. 17B is a close up of the circled portion in FIG. 17A, showing the lock assembly and one of the key assemblies.
Figure 17C:
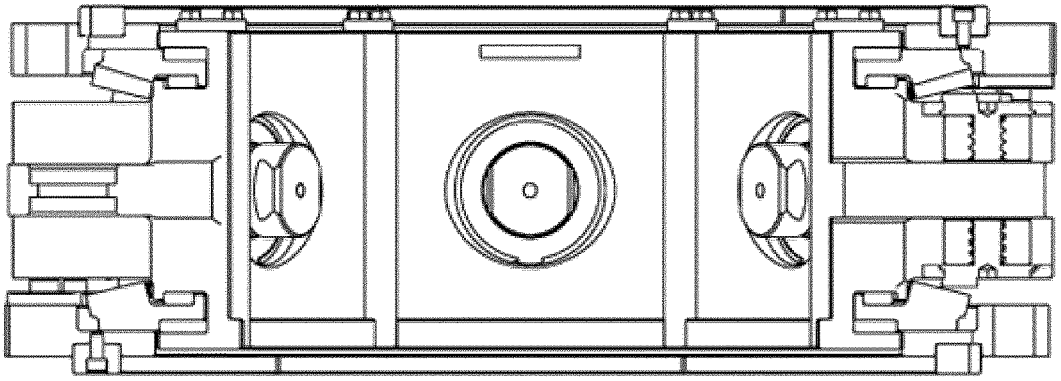
FIG. 17C is a vertical cross-section view taken along plane A-A of FIG. 17A.

FIGS. 17A and 17B show initial contact between upper key assembly 102 and upper lock assembly 101 as upper ring gear-bevel gear assembly 138 rotates clockwise. The tip of radial projection 129 of upper key assembly 102 strikes the tip of first radial projection 104 of upper lock assembly 101. Note that the initial orientations of radial projection 129 and radial projection 104 described above are such that first radial projection 104 obstructs radial projection 129. In order for radial projection 129 to continue along its circular path and pass first radial projection 104, radial projection 129 must push first radial projection 104 in the direction of rotation of upper ring gear-bevel gear assembly 138, in this case clockwise. As a result, lock 103 rotates in a clockwise direction by a predetermined amount, in this embodiment by approximately 120 degrees.

Figure 18A:
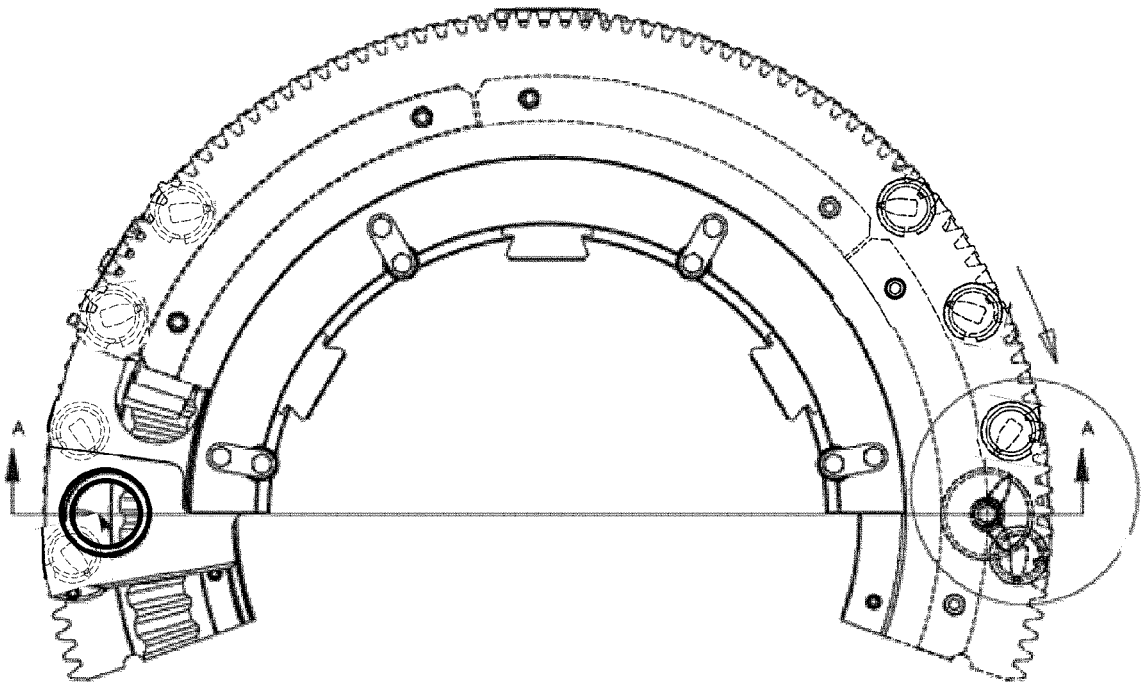
FIG. 18A is a partially see-through top plan view of one of the C-shaped halves of the rotating assembly of the embodiment shown in FIG. 6, in a partially locked configuration.
Figure 18B:
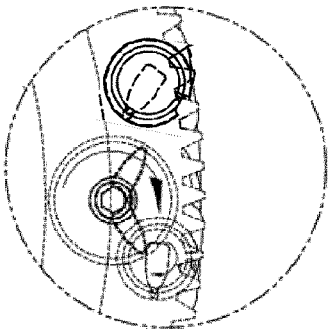
FIG. 18B is a close up of the circled portion in FIG. 18A, showing the lock assembly and two of the key assemblies.
Figure 18C:
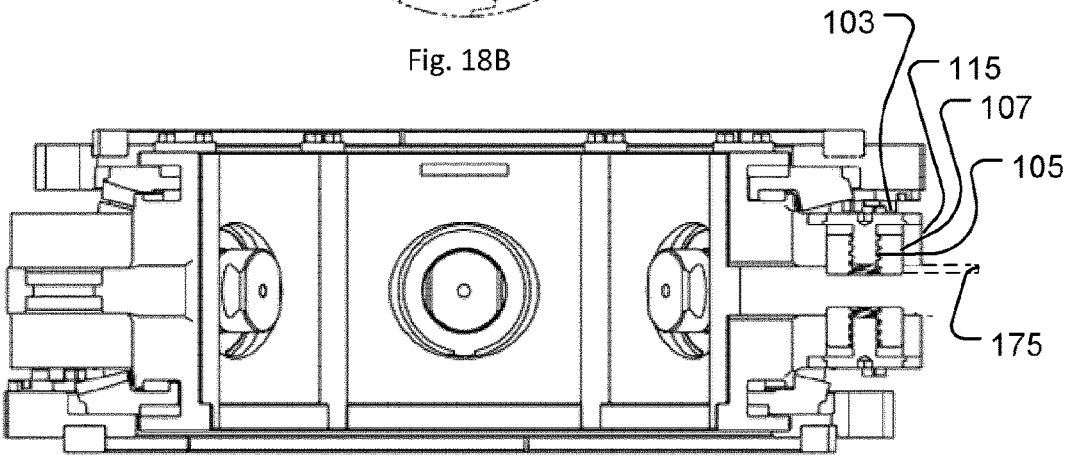
FIG. 18C is a vertical cross-section view taken along plane A-A of FIG. 18A.

In order to overcome the initial inertia and frictional forces associated with rotation of lock 103, radial projection 129 is forced to rotate slightly in the counter-clockwise direction. Such rotation of radial projection 129 is against the bias of spring 127, and such rotation is limited by the maximum travel of pin 131 within aperture 133. As upper ring gear-bevel gear assembly 138 rotates clockwise further, lock 103 rotates sufficiently to allow radial projection 129 to pass first radial projection 104, as shown in FIGS. 18A and 18B. As can be seen in the difference between FIGS. 17C and 18C, rotation of lock 103 as radial projection 129 passes through results in cylinder 107 moving downward in aperture 113 of upper collar 115 into an aperture of a middle collar (not shown) of the bevel pinion carrier from the opposing jaw 188. The middle collar fits between upper collar 115 and lower collar 115A of bevel pinion gear 142, and the aperture of the middle collar is coaxial with and has the same diameter as aperture 113 (and the aperture of the lower collar). Thus the downward movement of cylinder 107 of upper lock assembly 101 into the aperture of the middle collar results in locking between the bevel pinion carriers of opposing jaws 188.

Figure 19A:
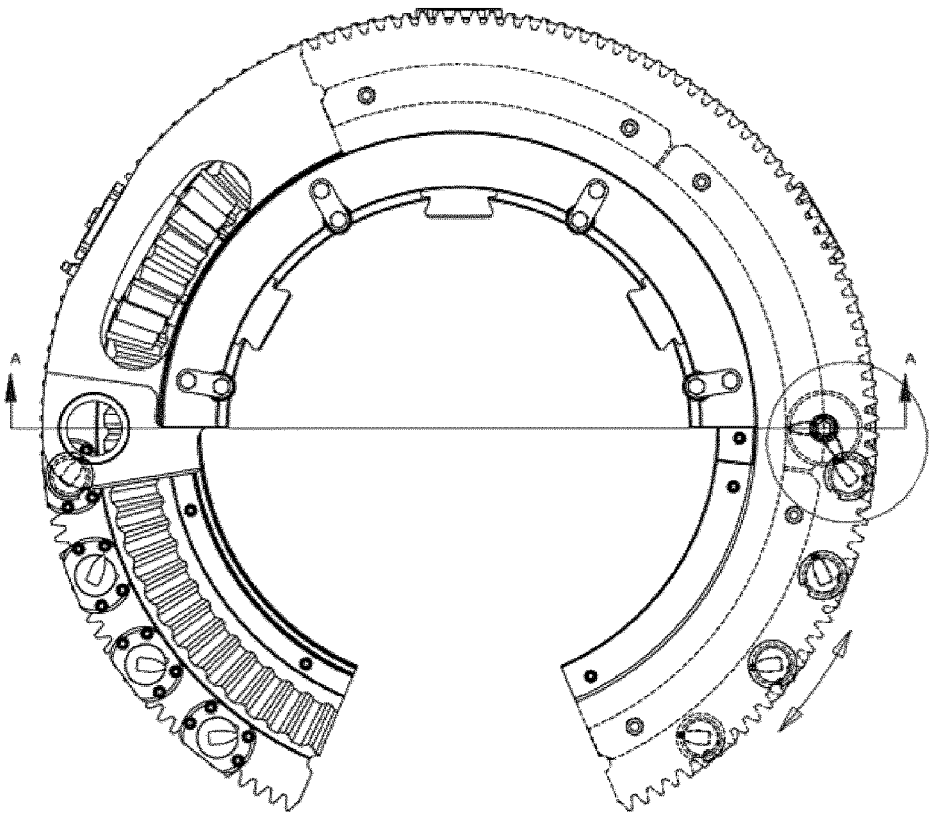
FIG. 19A is a partially see-through top plan view of one of the C-shaped halves of the rotating assembly of the embodiment shown in FIG. 6, in a fully locked configuration.
Figure 19B:
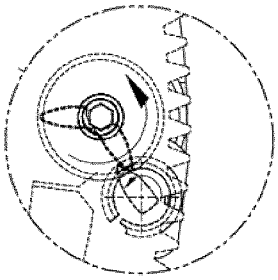
FIG. 19B is a close up of the circled portion in FIG. 19A, showing the lock assembly and one of the key assemblies.
Figure 19C:
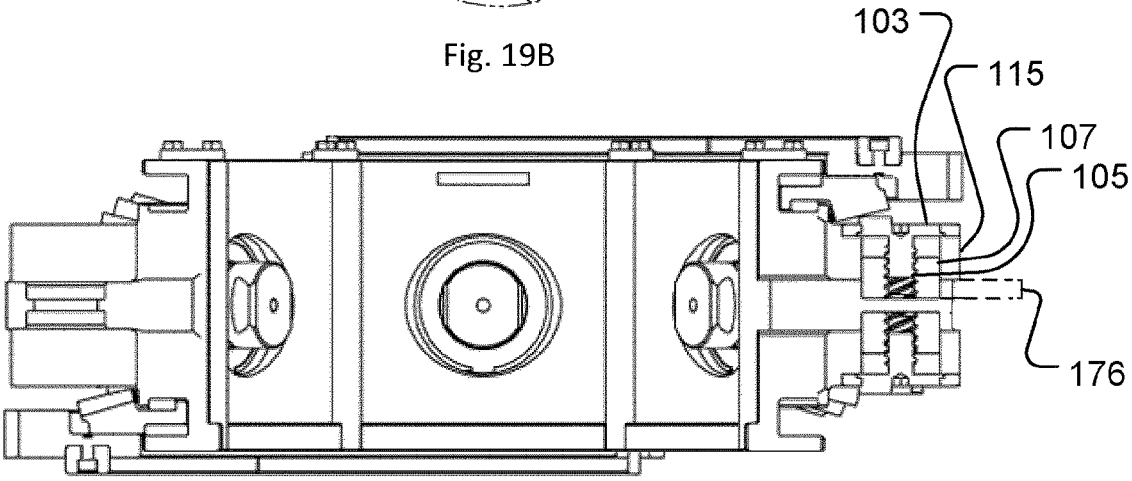
FIG. 19C is a vertical cross-section view taken along plane A-A of FIG. 19A.

FIG. 19A to 19C shows wrench 100 in a closed and locked position. The illustrated position of lock 103 is after upper key assemblies 102, 102', 102", 102''' sequentially passed over upper lock assembly 101. Note that after upper key assemblies 102 and 102' pass over upper lock assembly 101, the orientations of lock 103 and upper key assemblies 102" and 102''' are such that there would be no contact between them. Note also that, after passage of upper key assembly 102' over lock 103, cylinder 105 is now at a greater, second depth 176 within the aperture of the middle collar (see FIG. 19C) to provide more secure locking.

To unlock wrench 100, upper ring gear-bevel gear assembly 138 is rotated counter-clockwise to bring upper key assemblies 102, 102', 102", 102''' sequentially over upper lock assembly 101 again in the opposite direction. This time, upper key assemblies 102" and 102''' have an orientation that will strike lock 103, and rotate lock 103 in the opposite direction such that cylinder 105 will withdraw back into collar 115, to cause unlocking of wrench 100. During unlocking, upper key assemblies 102 and 102', due to their default orientation, and lock 103, due to its orientation after being struck by upper key assemblies 102''' and then 102", will not contact each other.

As a person skilled in the art would readily understand from the description above and FIGS. 16 to 19 regarding locking and unlocking of wrench 100, the interaction between upper lock assembly 101 in upper collar 115 and upper key assemblies 102,102', 102", 102''' on upper ring gear-bevel gear assembly 138 is mirrored by the interaction between lower lock assembly 101A in lower collar 115A and lower key assemblies 102A, 102A', 102A", 102A'''' on lower ring gear-bevel gear assembly 140.

Figure 20:
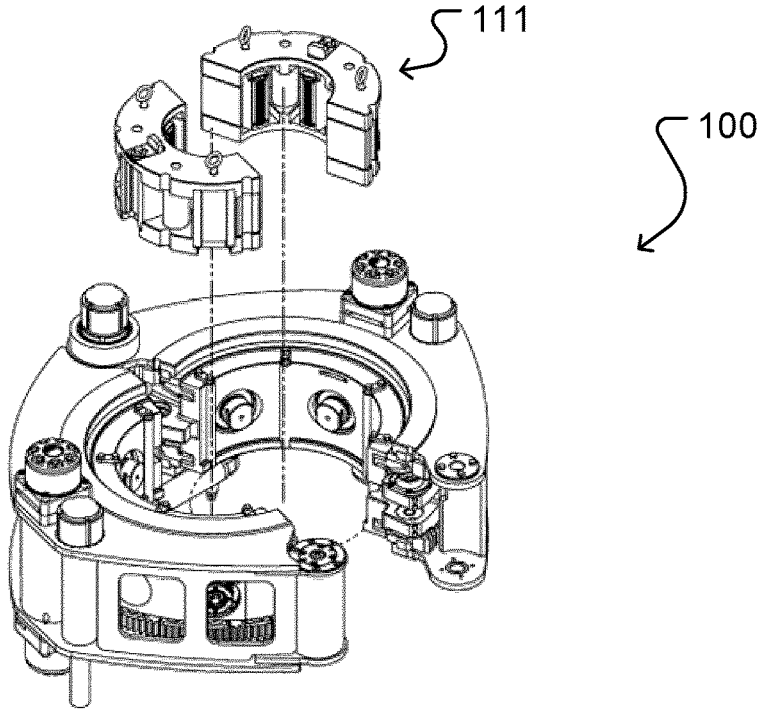
FIG. 20 is an isometric view of embodiment shown in FIG. 6, showing in isolation two C-shaped halves of a gripping assembly for piping.
Figure 21:
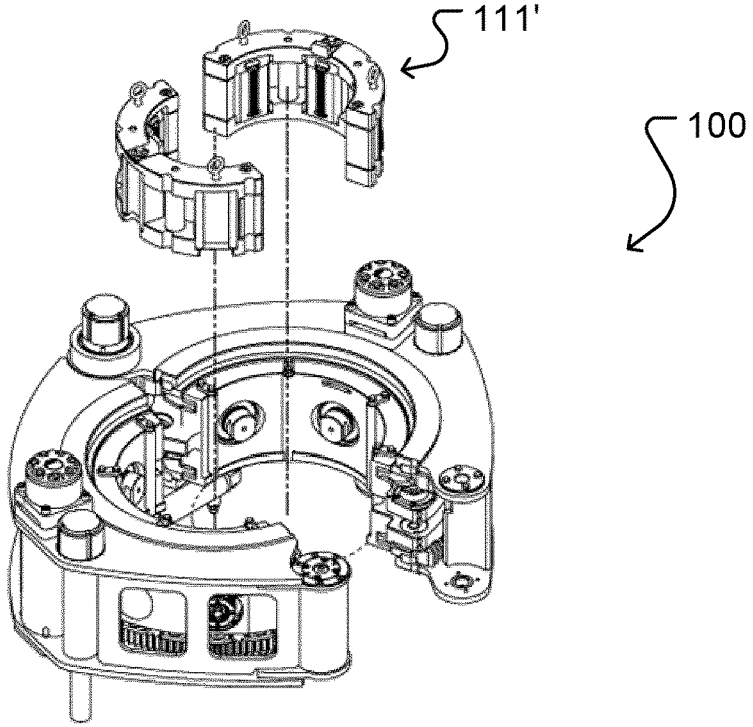
FIG. 21 is an isometric view of embodiment shown in FIG. 6, showing in isolation two C-shaped halves of the gripping assembly for casing.

In some embodiments, gripping assembly 111 of wrench 100 is interchangeable to accommodate tubulars T of different diameters. For example, FIG. 20 shows a gripping assembly 111 adapted to grip piping whereas FIG. 21 shows a gripping assembly 111' adapted to grip casing.

Where a component is referred to in the specification or shown in the Figures, unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention. For example, the various support bearings shown throughout the Figures are shown as non-split, roller type bearings, but those skilled in the art will appreciate that other types of bearings may be substituted with similar results.

Embodiments of the invention thus provide a correlation between torque and gripping force applied because the torque is transferred from the bevel ring gears to the bevel pinions and on to the bevel pinion carrier (and then on to the gripping assembly and ultimately the tubular gripped by the gripping assembly). However, in order for the torque to reach the bevel pinion carrier, the bevel pinions themselves have to be prevented from spinning, and this is achieved in the present invention by the dies contacting and gripping a tubular. Embodiments require gripping force, rather than for example some independent braking mechanism, to be applied in order for the torque to be achieved. Embodiments can achieve reasonably long gripping stroke (similar to roughnecks using hydraulic rams for gripping) while ensuring a pre-determined relationship between torque and gripping force.

This specification is intended to cover any variations, uses, or adaptations of the invention using its general principles. For example, with reference to wrench 10 (and equally applicable to corresponding features of wrench 100):

Driving assemblies 18 may be configured and arranged in any manner that allows for upper ring gear 30 and lower ring gear 32 to be independently driven. In some embodiments, upper ring gear 30 and lower ring gear 32 may each be driven by a single corresponding driving assembly 18 rather than a pair of drive assemblies 18. In some embodiments, a single driving assembly 18 with vertically adjustable drive pinions 26 may drive both upper ring gear 30 and lower ring gear 32, wherein in a first configuration a first drive pinion 26 engages upper ring gear 30 and in a second configuration a second drive pinion 26 (on the same axis as the first drive pinion 26) engages lower ring gear 32. In some embodiments, a gear train, instead of a single drive pinion 26, may be provided for meshing connection between motors 28, 28' of driving assemblies 18, 18' and upper ring gear 30 and lower ring gear 32.

Upper ring gear 30 and lower ring gear 32 may be teethed along their inner circumferences, and thereby mesh with drive pinions 26, 26' of driving assemblies 18, 18' along such inner circumferences instead of along their outer circumferences. Driving assemblies 18, 18' in such embodiments would at least partially extend into the central openings of upper ring gear 30 and lower ring gear 32.

Upper ring gear 30 and upper bevel gear 34 may be manufactured as a single, integral component. Similarly, lower ring gear 32 and lower bevel gear 36 may be manufactured as a single, integral component.

Bevel pinion 46 and carrier 52 may be manufactured as a single, integral component.

Die 58 and die carrier 60, that is, die assembly 61, may be manufactured as a single, integral component.

Torque transfer pins 64 may be substituted with other torque transfer elements that function to transfer torque from bevel pinion carrier 42 to die carrier 62.

A spring pack 70 may be provided between die carrier 60 and actuating rod adapter 56 to compensate for minor dimensional and/or shape irregularities in manufacturing and/or operation. Spring pack 70 may be disposed in a recess 72 in die carrier 60.

Carrier 52 may have a male thread and actuating rod 54 may have a female thread.

The number of bevel pinion assemblies 44 in bevel pinion carrier 42 may vary from two (i.e., one opposing pair) to greater than six. In some embodiments an odd number of bevel pinion assemblies 44 may be provided.

And for example with reference to wrench 100:

Instead of an upper and lower collar of one C-shaped half of a bevel pinion carrier interleaving with a middle collar of the other C-shaped half of a bevel pinion carrier, some embodiments may simply have one collar from each of the C-shaped halves of the bevel pinion carrier, with only one cylinder and one lock assembly/key assembly achieving the locking action.

Instead of two leading key assemblies and two trailing key assemblies on a bevel gear, some embodiments may only have two key assemblies per bevel gear (one leading and one trailing), with the lock having only one radial projection, which would achieve somewhat shallower locking.

Rotation of the lock assembly may be achieved by means other than engagement of radial projections of the lock and key. For example, the keys may comprise fixed pinions and the locks may comprise rotating pinions, whereby transiting keys allow for engagement of the pinions whereby the locks' pinions rotate. Or for example, the rotation of the lock may be achieved by keys having magnets that cause the lock to rotate as the keys pass by.

This application is intended to cover such departures from the present disclosure as come within known or customary practice in the art to which this invention pertains and which fall within the limits of the appended claims. Accordingly, the scope of the claims should not be limited by the preferred embodiments set forth in the description, but should be given the broadest interpretation consistent with the description as a whole.

The invention claimed is:

1. A torque wrench, comprising:

a) a housing;

b) a rotating assembly rotatably mounted in the housing and comprising:

(i) a gripping assembly comprising:
an aperture for receiving a tubular and
a die assembly;

(ii) a bevel pinion carrier assembly comprising
a bevel pinion carrier and
a bevel pinion mounted in the bevel pinion carrier;

(iii) an upper ring gear fixed to an upper bevel gear rotatably connected to the bevel pinion at an upper side of the bevel pinion carrier;

(iv) a lower ring gear fixed to a lower bevel gear rotatably connected to the bevel pinion at a lower side of the bevel pinion carrier; and (v) first and second members threadably coupleable with each other, the first threadably coupleable member fixedly connected to the bevel pinion and the second threadably coupleable member drivingly connected to the die assembly, wherein rotation of the bevel pinion drives the die assembly toward and away from the tubular;

c) at least one upper drive pinion rotatably mounted to the housing, and rotatably connectable to the upper ring gear; and d) at least one lower drive pinion rotatably mounted to the housing, and rotatably connectable to the lower ring gear.

2. A torque wrench according to claim 1, comprising a plurality of bevel pinions circumferentially mounted in the bevel pinion carrier, and a plurality of die assemblies, each die assembly corresponding with a bevel pinion.

3. A torque wrench according to claim 2, wherein each die assembly comprises a die carrier and at least one die for gripping the tubular.

4. A torque wrench according claim 3, wherein each die assembly is slidably mounted in a die assembly carrier.

5. A torque wrench according to claim 4, comprising a plurality of torque transfer elements disposed between the bevel pinion carrier and each of the die assembly carriers.

6. A torque wrench according to claim 5, wherein the bevel pinion carrier and each of the die assembly carriers comprise corresponding recesses for partially receiving the torque transfer elements therebetween.

7. A torque wrench according to claim 1, wherein the first threadably coupleable member comprises a threaded female carrier about which the bevel pinion is fixed.

8. A torque wrench according to claim 7, wherein the bevel pinion and the threaded female carrier are integrally formed.

9. A torque wrench according to claim 8, wherein the second threadably coupleable member comprises a threaded male actuating rod.

10. A torque wrench according to claim 9, wherein the threaded male actuating rod is drivingly connected to the die assembly by an actuating rod adapter.

11. A torque wrench according to claim 1, further comprising:

an opposing pair of upper driving assemblies each comprising a motor and an upper drive pinion; and an opposing pair of lower driving assemblies each comprising a motor and a lower drive pinion, wherein the opposing pair of upper driving assemblies and the opposing pair of lower driving assemblies are circumferentially arranged in corresponding slots in a sidewall of the housing.

12. A torque wrench according to claim 1, wherein the upper ring gear and upper bevel gear are integrally formed and the lower ring gear and the lower bevel gear are integrally formed.

13. A torque wrench according to claim 1, further comprising two jaws, each jaw comprising a corresponding C-shaped half of each of the housing and the rotating assembly, wherein the jaws are pivotally mounted at a jaw pivot, whereby the jaws are configurable in an open position to receive the tubular and a closed position to clamp the tubular.

14. A torque wrench according to claim 13, further comprising a support assembly comprising a support plate and a pair of articulating support arms, wherein each support arm is pivotally connected at one end to the support plate and pivotally connected at the other end to a support arm pivot disposed on each of the jaws, and wherein the jaw pivot is supported by the support plate.

15. A torque wrench according to claim 14, further comprising a pair of opposing driving assemblies each comprising a motor, an upper drive pinion and a lower drive pinion, wherein each of the jaws comprises one of the pair of opposing driving assemblies.

16. A torque wrench according to claim 13, wherein a die assembly carrier associated with the die assembly is interchangeable to accommodate tubulars of different diameters.

17. A torque wrench according to claim 13, wherein the jaws are lockable in the closed position.

18. A torque wrench according to claim 17, wherein the bevel pinion carrier comprises two C-shaped halves, wherein a terminal end of one of the two C-shaped halves comprises an upper collar and lower collar, and a terminal end of the other of the two C-shaped halves comprises a middle collar that interleaves between the upper collar and the lower collar when the jaws are in the closed position.

19. A torque wrench according to claim 18, wherein each of the upper, middle and lower collar comprise an aperture coaxial with the apertures of the other collars when the jaws are in the closed position.

20. A torque wrench according to claim 19, comprising:

a) an upper lock assembly disposed on the upper collar of the bevel pinion carrier, and a lower lock assembly disposed on the lower collar of the bevel pinion carrier, each of the lock assemblies comprising:

(i) a rotatable lock comprising at least one radial projection on one face and a threaded member extending from the other face; and (ii) a cylinder slidingly disposed in a corresponding one of the upper collar and the lower collar, the cylinder comprising a threaded member engaged with the threaded member of the corresponding rotatable lock, wherein the cylinder is restricted from rotating about its axis; and b) a plurality of upper key assemblies disposed on the upper bevel gear, and a plurality of lower key assemblies disposed on the lower bevel gear, each of the key assemblies comprising a radial projection;

wherein the lock assemblies and the key assemblies are arranged such that rotation of the upper and lower bevel gears relative to the bevel pinion carrier results in rotation of the rotatable locks due to engagement between the radial projections of the key assemblies and the at least one radial projection of the rotatable locks, whereby due to rotation of the rotatable locks, depending on rotational direction, the cylinders move out of the respective upper and lower collars into the middle collar to lock the jaws, or move out of the middle collar into their respective upper and lower collars to unlock the jaws.

* * * * *